US006902877B2

(12) United States Patent
Maruyama et al.

(10) Patent No.: US 6,902,877 B2
(45) Date of Patent: Jun. 7, 2005

(54) SILVER HALIDE PHOTOGRAPHIC EMULSION

(75) Inventors: Yoichi Maruyama, Minami-Ashigara (JP); Genichi Furusawa, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/374,084

(22) Filed: Feb. 27, 2003

(65) Prior Publication Data

US 2003/0194665 A1 Oct. 16, 2003

(30) Foreign Application Priority Data

Mar. 1, 2002 (JP) ..... 2002-056091

(51) Int. Cl.[7] ..... G03C 1/005; G03C 1/494
(52) U.S. Cl. ..... 430/567; 430/568; 430/569
(58) Field of Search ..... 430/567, 568, 430/569

(56) References Cited

U.S. PATENT DOCUMENTS 4,414,306 A 11/1983 Wey et al.
4,414,310 A 11/1983 Daubendiek et al.
4,433,048 A 2/1984 Solberg et al.
4,434,226 A 2/1984 Wilgus et al.
4,439,520 A 3/1984 Kofron et al.
4,459,353 A 7/1984 Maskasky
5,709,988 A * 1/1998 Black et al. ..... 430/567
6,534,257 B2 * 3/2003 Kikuchi ..... 430/567
6,632,595 B2 * 10/2003 Kikuchi et al. ..... 430/568

FOREIGN PATENT DOCUMENTS

JP 142169 A 5/2001

* cited by examiner

*Primary Examiner*—Geraldine Letscher
(74) *Attorney, Agent, or Firm*—Sughrue Mion, PLLC

(57) ABSTRACT

A silver halide photographic emulsion comprising grains, wherein not less than 50% of the number of all the grains are occupied by silver iodebromide or silver bromochloroiodide tabular grains each meeting the requirements (i) to (iii) below:

(i) a thickness is less than 0.13 $\mu$m;

(ii) an equivalent-circle diameter is not less than 1.0 $\mu$m; and (iii) a silver iodide content in a fringe internal region A between a twin plane and a grain major surface is higher than a silver iodide content in a fringe internal region B between two twin planes.

17 Claims, 2 Drawing Sheets

SILVER HALIDE PHOTOGRAPHIC EMULSION

CROSS-REFERENCE TO RELATED APPLICATIONS

This application is based upon and claims the benefit of priority from the prior Japanese Patent Application No. 2002-056091, filed Mar. 1, 2002, the entire contents of which are incorporated herein by reference.

BACKGROUND OF THE INVENTION

1. Field of the Invention

The present invention relates to a silver halide photographic emulsion with a high sensitivity and sharpness and improved dependence on processing.

2. Description of the Related Art

Recently, compact cameras provided with a zoom lens are increasing, and compact zoom cameras with high zoom ratios, such as 3:1 and 4:1, are becoming the mainstream. These zoom cameras are not always satisfactory in respect of image quality, although they are useful for readily taking pictures. For example, in some types of such cameras the f-number of the lens exceeds 10 when the lens has been shifted to the telephoto side, which tends to cause under-exposure. Further, the strobe range of compact cameras is short, and in many cases under-exposure occurs. A film with a high sensitivity which can improve such a situation is desired.

In 1996, Advanced Photo System (APS) cameras having a smaller picture size on the film than the conventional 135 format were put on the market. Since the film-print enlarging ratio of the APS format is greater than that of the conventional 135 format, APS requires films of a higher image quality.

To meet such demands, development of tabular silver halide grains have been made in order to increase photographic sensitivity and reduce the grain size. Methods of manufacturing tabular silver halide grains and techniques of use thereof have already been disclosed in U.S. Pat. Nos. 4,434,226, 4,439,520, 4,414,310, 4,433,048, 4,414,306, and 4,459,353, etc. These documents disclose the advantages of tabular silver halide grains, such as improvement in the relationship between sensitivity and graininess, including improvement in color sensitization efficiency by using spectral sensitizing dyes.

However, when the aspect ratio (grain equivalent circle diameter/grain thickness) of each grain is increased to pursue the advantages of tabular grains, the grain thickness is reduced. In particular, a photosensitive material using grains each having a thickness of less than 0.13 $\mu$m and an equivalent-circle diameter of 1.0 $\mu$m or more proved to be inferior in processing stability, and could not be put to practical use. Therefore, it was impossible to use very thin tabular grains, each having a thickness of less than 0.13 $\mu$m, for films with a high image quality and high sensitivity.

BRIEF SUMMARY OF THE INVENTION

Therefore, the object of the present invention is to provide a silver halide photographic emulsion which achieves high sensitivity and high image quality in a silver halide photographic lightsensitive material, and improves dependence on processing of the material.

As a result of exhaustive study by the inventors of the present invention, it has been found that the above object of the present invention can be achieved by using tabular silver halide grains having a grain thickness of less than 0.13 $\mu$m and a specific structure. Specifically, the present invention provides the following silver halide photographic emulsion, and silver halide photographic lightsensitive material using the emulsion.

(1) A silver halide photographic emulsion, characterized in that 50% or more in number of all the grains of the emulsion are occupied by silver iodebromide or silver bromochloroiodide tabular grains each meeting the requirements (i) to (iii) below: (i) a thickness is less than 0.13 $\mu$m; (ii) an equivalent-circle diameter is not less than 1.0 $\mu$m; and (iii) a silver iodide content in a fringe internal region A (any of regions $A_1$ and $A_2$) between a twin plane and a grain major surface is higher than a silver iodide content in a fringe internal region B between two twin planes.

(2) The silver halide photographic emulsion according to (1), the tabular grain thickness is less than 0.10 $\mu$m.

(3) The silver halide photographic emulsion according to (1) or (2), wherein the silver iodide content in the fringe internal region A is 7 mol % or more.

(4) A silver halide photographic lightsensitive material having at least one lightsensitive silver halide emulsion layer on a support, wherein the lightsensitive silver halide emulsion layer contains the silver halide photographic emulsion according to any one of (1) to (3).

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
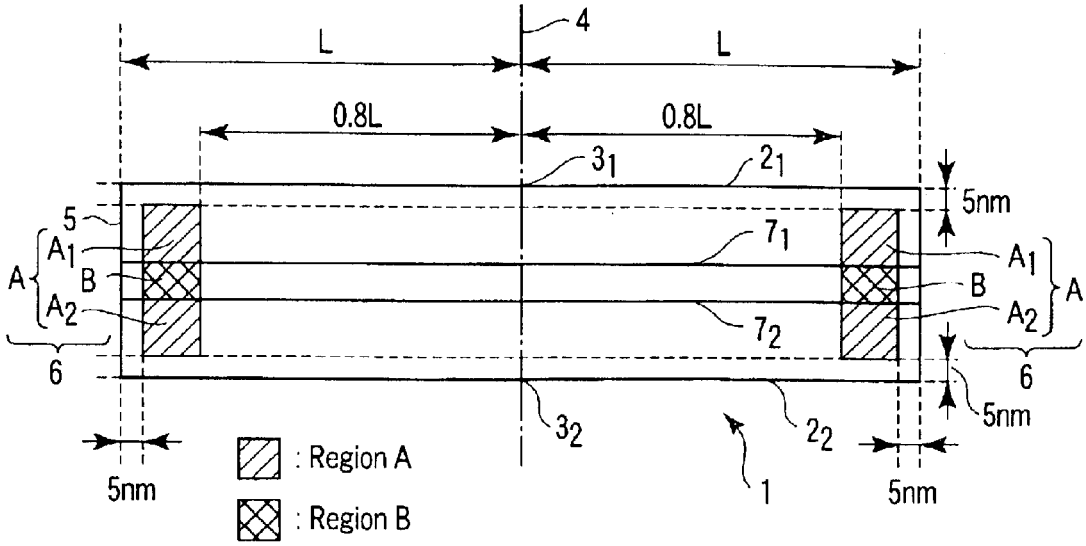
FIG. 1 is a cross-sectional view of a tabular grain contained in an emulsion of the present invention.

The present invention will now be detailed.

In the present invention, a tabular grain refers to a silver halide grain having two opposing, parallel (111) major surfaces. In the present invention, a tabular grain has two or more parallel twin planes. The twin plane is a (111) plane on the two sides of which ions at all lattice points have a mirror image relationship.

When the tabular grain is viewed in a direction perpendicular to the major surfaces of the grain, it has any of a triangular, hexagonal, and triangular shape whose vertexes are truncated (i.e., shape between triangular and hexagonal shapes), each having parallel major surfaces.

The equivalent-circle diameter and thickness of a tabular grain are obtained by taking a transmission electron micrograph by the replica method. That is, the equivalent-circle diameter is calculated as the diameter (equivalent-circle diameter) of a circle having an area equal to the projected area of each individual grain. The thickness is calculated from the length of the shadow of a replica. The equivalent-circle diameter of all the grains and the variation coefficient thereof, and the thickness of all the grains and the variation coefficient thereof are determined by using each of the values obtained by the above methods with regard to 1000 or more grains.

An emulsion of the present invention is preferably monodisperse. In the present invention, a monodisperse emulsion has a variation coefficient of the equivalent-circle diameters of all silver halide grains of 30% or less, preferably 20% or less. The variation coefficient of equivalent-circle diameters is the value obtained by dividing the standard deviation of the distribution of the equivalent-circle diameters of individual silver halide grains by the average equivalent-circle diameter. In the present invention, the range of the equivalent circle diameters is preferably 1.0 μm to 10 μm, more preferably 1.0 μm to 6 μm, and most preferably 1.0 μm to 4 μm.

In an emulsion of the present invention, tabular grains each having a thickness less than 0.13 μm, preferably less than 0.1 μm, constitute at least 50% of the number of all the grains of an emulsion, preferably at least 70%, more preferably at least 90%.

When silver halide grains are chemically sensitized, the grains are difficult to optimally sensitize if non-uniformity exists between the grains. This reduces the photographic sensitivity. From this point of view, the thickness of the tabular grains is preferably monodisperse.

The variation coefficient of the thickness of the grains is preferably 30% or less, more preferably 20% or less.

Although the distance between twin planes of the tabular grains used in the invention is not specifically limited, 50% or more in number of all the grains preferably have a distance between twin planes of 0.016 μm or less, more preferably 0.014 μm or less, and most preferably 0.012 μm or less. In a tabular grain having three or more twin planes, the distance between the most separated two twin planes is the distance between the twin planes.

The distance between twin planes can be obtained by observing an ultra-thin segment of a grain through a transmission electron microscope. In the specification, the case where 50% or more in number of all the grains have a distance between twin planes of 0.016 μm or less means the case where the distances of 1000 or more grains are measured and 500 or more grains have the distance of 0.016 μm or less. The variation coefficient of the distance between twin planes can also be obtained by measuring the distances of 1000 or more grains.

The distribution of the distances between the twin planes of tabular grains is also preferably monodisperse in respect of the uniformity between the grains. This further facilitates optimum chemical sensitization of grains. The variation coefficient of the distance between twin planes of tabular grains is preferably 40% or less, and more preferably 30% or less.

The structure of a tabular grain of the present invention will now be detailed with reference to the drawings.

Figure 2:
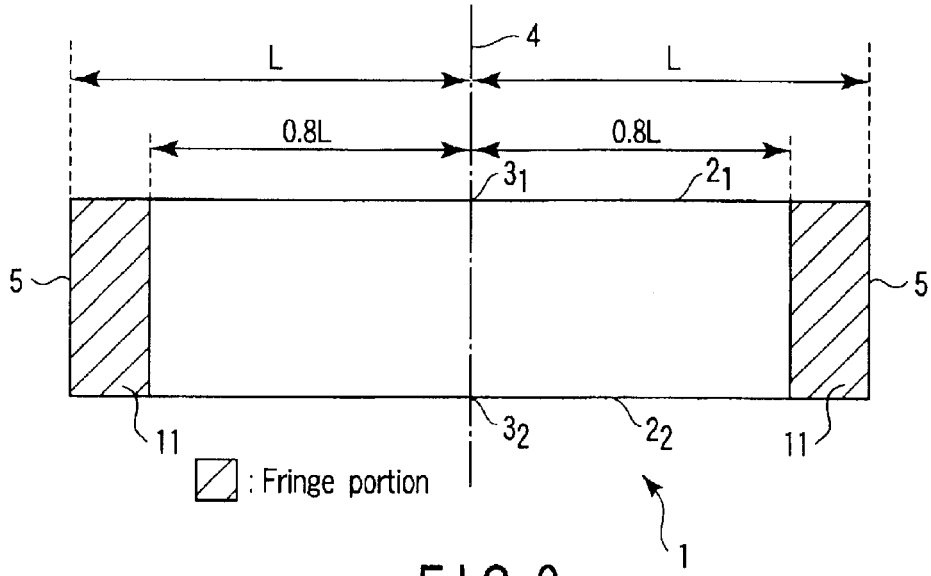
FIG. 2 is a cross-sectional view showing a fringe portion of a tabular grain contained in an emulsion of the present invention.

FIG. 1 is a cross-sectional view typically showing a tabular grain 1 which is a typical tabular grain having two twin planes, among grains contained in an emulsion of the present invention. The cross-sectional view is obtained by cutting the tabular grain along a line running through centers of gravity $\mathbf{3}_1$ and $\mathbf{3}_2$ in the major surfaces $\mathbf{2}_1$ and $\mathbf{2}_2$ of the tabular grain, and in a direction perpendicular to the major surfaces $\mathbf{2}_1$ and $\mathbf{2}_2$. FIG. 2 also shows the same cross-sectional views as FIG. 1.

In the present invention, a fringe portion 11 is a portion 0.8 L or more distant from the center line 4 of the grain, when the distance between the center line 4 and a side surface 5 is L, as shown in the cross-sectional view of FIG. 2. The center line 4 is a line drawn through the center of gravity $\mathbf{3}_1$ of the major surface $\mathbf{2}_1$ and perpendicularly to the major surfaces, as shown in the cross-sectional views of FIGS. 1 and 2. The distance between the center line 4 and the side surface 5 is the distance of a line which extends parallel to the major surfaces from any point existing on the center line 4 (that is, a central point). The line ranges from the central point to the side surface of the tabular grain.

Figure 3:
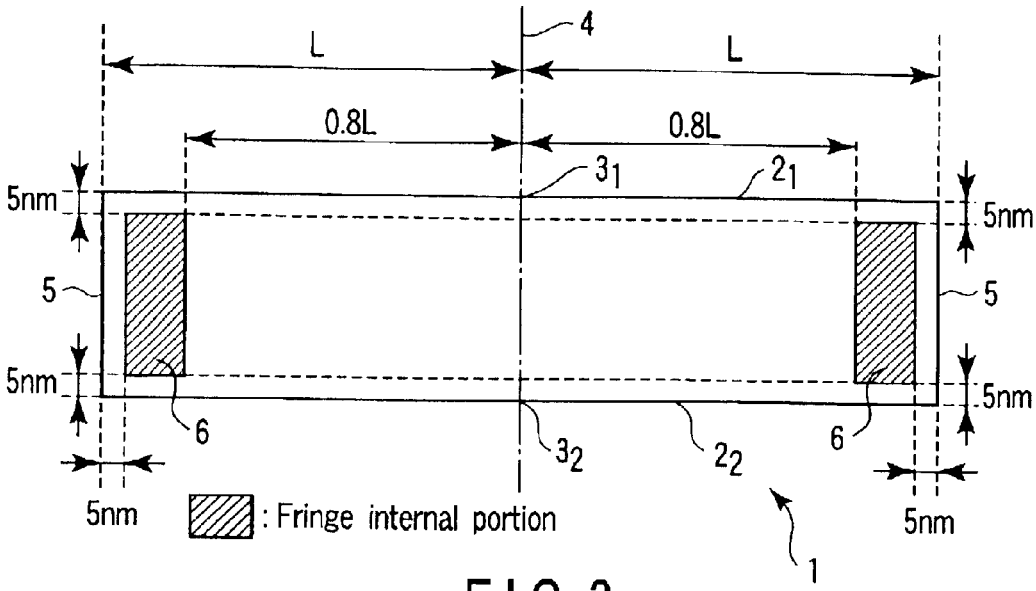
FIG. 3 is a cross-sectional view showing a fringe internal portion of a tabular grain contained in an emulsion of the present invention.
Figure 4:
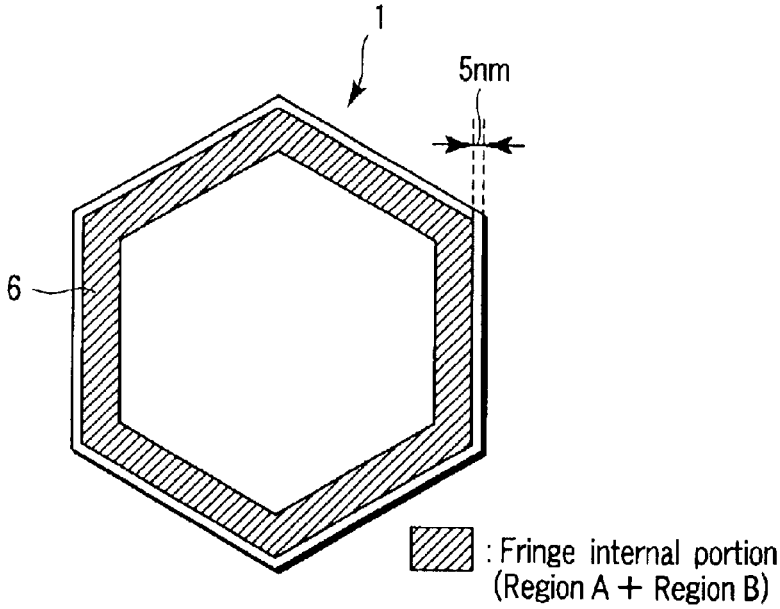
FIG. 4 is a view showing a fringe internal portion consisting of regions A and B in the case of viewing in a direction perpendicular to the major surfaces of a tabular grain contained in an emulsion of the present invention.

In the present invention, a fringe internal portion 6 is a portion at least 5 nm inside from the external surfaces (major surfaces $\mathbf{2}_1$ and $\mathbf{2}_2$, and side surface 5), in the fringe portion 11 defined above. In FIGS. 3 and 4, fringe internal portion 6 is shown by a region with oblique lines. FIG. 3 is the same cross-sectional view as FIG. 1. FIG. 4 shows a portion in which fringe internal portion 6 (consisting of fringe internal regions A and B) exists, when the tabular grain 1 is viewed in a direction perpendicular to the major surface $\mathbf{2}_1$ or $\mathbf{2}_2$.

In the present invention, a fringe internal region A is a region of the fringe internal portion 6 between one twin plane ($\mathbf{7}_1$ or $\mathbf{7}_2$) and one major surface ($\mathbf{2}_1$ or $\mathbf{2}_2$). A combination of the twin plane and the major surface is one twin plane and the major surface closer to the twin plane. Specifically, if the upper twin plane $\mathbf{7}_1$ is selected as one twin plane, the upper major surface $\mathbf{2}_1$ should be selected as the major surface to be combined. On the other hand, if the lower twin plane $\mathbf{7}_2$ is selected as one twin plane, the lower major surface $\mathbf{2}_2$ should be selected as the major surface to be combined. As shown in FIG. 1, the fringe internal region A consists of a region $A_1$ existing in the upper portion of the grain and a region $A_2$ existing in the lower portion of the grain. The two regions $A_1$ and $A_2$ are generally disposed at positions of plane symmetry, and their halogen compositions are the same.

In the present invention, fringe internal region B is a region of the fringe internal portion 6 sandwiched by two twin planes ($\mathbf{7}_1$ and $\mathbf{7}_2$) In other words, fringe internal region B is a region obtained by removing the above fringe internal region A from the fringe internal portion 6.

If a tabular grain has three or more twin planes, fringe internal region A and fringe internal region B are determined by selecting the most distant two twin planes as the twin planes.

The local silver iodide content in the tabular grain can be obtained by an analytical electron microscope. In the present invention, the tabular grain is cut in slices perpendicularly to the major surfaces by the following method, and an electron beam is irradiated in the side surface direction of the grain to perform measurement. Specifically, an emulsion sampled during grain formation, a final grain emulsion after grain formation has been completed, or a grain emulsion contained in a lightsensitive material, which is obtained by processing with a protease and subjecting to centrifugal separation, is coated on a triacetylcellulose support, and the grains are embedded in a resin. From this sample, a section having a thickness of about 50 nm is obtained using an ultramictrotome, and the section is placed on a copper mesh covered with a support film.

In a portion to be measured of the grain, the silver iodide content is measured and performing spot analysis with a spot diameter of 2 nm or less by using an analytical electron microscope. The silver iodide content can be obtained by obtaining in advance, as a working curve, the ratio of the Ag intensity to the I intensity by processing silver halide grains whose silver iodide content is known in the same manner. As a source of the analysis line of the analytical electron microscope, a field-emission type electron gun having a high electron density is more suitable than one using thremoelectrons. By narrowing the spot diameter to 1 nm or less, the halogen composition of a minute part can easily be analyzed.

The emulsion containing the tabular grains of the present invention is characterized in that at least 50%, preferably at least 65%, and more preferably at least 80%, in number of all the grains have the silver iodide content in the above region A higher than a silver iodide content in the above region B. Throughout this specification, the silver iodide content in the region A means an average silver iodide content in the region A of a grain, and the silver iodide content in the region B means an average silver iodide content in the region B of a grain. The average silver iodide content in each of the regions A and B is obtained by measuring silver iodide contents in a plurality of spots of each of the regions A and B of a grain by using an analytical electron microscope as described above and taking an average. The term "at least 50% in number of all the grains" means that at least 50 grains meet the requirements when 100 grains are measured by the above method.

Further, the silver iodide content in the region A is preferably 7 mol % or more, more preferably 10 mol % or more, and most preferably 12 mol % or more.

The emulsion of present invention is characterized in that at least 50% in number of all the grains have the silver iodide content in the region B lower than the silver iodide content in the region A.

The silver iodide content in the region B is less than that in the region A preferably by 2 mol % or more, more preferably by 4 mol % or more, and most preferably by 7 mol % or more.

It is an unexpected new discovery that such a silver iodide structure improves the dependence on processing.

Preparation of the tabular grains of the present invention basically comprises a combination of three steps of nucleation, ripening and growth. Although the methods disclosed in U.S. Pat. No. 4,797,354 and Jpn. Pat. Appln. KOKAI Publication No. (hereinafter referred to as JP-A-) 2-838 can be referred to for preparation of the tabular grains of the present invention, their conditions need to be changed. The disclosures of these documents are incorporated herein by reference.

Tabular grain formation methods using polyalkyleneoxide compounds described in U.S. Pat. Nos. 5,147,771, 5,147,772, 5,147,773, 5,171,659, 5,210,013, and 5,252,453, the disclosures of which are incorporated herein by reference, are preferably used in the preparation of tabular grains of the present invention.

In the present invention, the silver bromide content of an emulsion grain is preferably 80 mol % or more, and more preferably, 90 mol % or more.

Also, the silver iodide content of an emulsion grain in the present invention is preferably 1 to 20 mol %, more preferably, 2 to 15 mol %, and most preferably, 3 to 10 mol %. A silver iodide content of less than 1 mol % is unpreferable because it is difficult to obtain the effects of enhancing dye adsorption and increasing the intrinsic sensitivity. A silver iodide content exceeding 20 mol % is also unpreferable because the developing speed generally lowers.

In the present invention, the silver chloride content is preferably 0 to 20 mol %, more preferably, 0 to 15 mol %, and most preferably, 0 to 7 mol %, and can be selected in accordance with the intended use.

In an emulsion of the present invention, assuming the specific silver iodide content is I mol % ($0.3<I<20$), silver halide grains having a silver iodide content of 0.7I to 1.3I account for preferably 100 to 50%, more preferably, 100 to 80%, and most preferably, 100 to 90% of the total number of grains. If the percentage fall outside this range, the effect of the present invention is difficult to obtain.

Furthermore, in an emulsion of the present invention, silver halide grains having a silver iodide content of 0.8I to 1.2I account for 100 to 50%, more preferably, 100 to 80%, and most preferably, 100 to 90% of the total number of grains.

The value of the specific silver iodide content I can be an arbitrary value within the range of ($0.3<I<20$), e.g., the average value when the silver iodide contents of individual grains are measured.

This "specific silver iodide content (I mol %)" concerning an emulsion of the present invention is a specific silver iodide content taking a value close to the average silver iodide content calculated on the formulation of the emulsion. I is a specific value exceeding 0.3 mol % and less than 20 mol %. It is possible to specify this value, by measuring the silver iodide contents of a group of specific emulsion grains separated from a specific emulsion layer of a silver halide photosensitive material, such that as many grains as possible fall within the range of 0.7I to 1.3I. Generally, the value is close to the arithmetic average value of the silver iodide contents of the group of the specific emulsion grains. It is practical to set the I value to the average silver iodide content on the formulation or to the measured average silver iodide content.

The silver iodide contents of individual emulsion grains can be measured by analyzing the composition of each individual grain by using an X-ray microanalyzer.

The measurement method is described in, e.g., European Patent 147,868.

A tabular grain of the present invention preferably has dislocation lines inside the grain. Introduction of dislocation lines into a tabular grain will be described below.

A dislocation line is a linear lattice defect at the boundary between a region already slipped and a region not slipped yet on a slip plane of crystal. Dislocation lines in a silver halide crystal are described in, e.g., 1) C. R. Berry. J. Appl. Phys., 27, 636 (1956); 2) C. R. Berry, D. C. Skilman, J. Appl. Phys., 35, 2165 (1964); 3) J. F. Hamilton, Phot. Sci. Eng., 11, 57 (1967); 4) T. Shiozawa, J. Soc. Photo. Sci. Jap., 34, 16 (1971); and 5) T. Shiozawa, J. Soc. Phot. Sci. Jap., 35, 213 (1972). Dislocation lines can be analyzed by an X-ray diffraction method or a direct observation method using a low-temperature transmission electron microscope. In direct observation of dislocation lines using a transmission electron microscope, silver halide grains, extracted carefully from an emulsion so as not to apply a pressure by which dislocation lines are produced in the grains, are placed on a mesh for electron microscopic observation. While the sample is cooled in order to prevent damage (e.g., print out) due to electron rays, the observation is performed by a transmission method.

Effects that dislocation lines have on photographic properties are described in G. C. Farnell, R. B. Flint, J. B. Chanter, J. Phot. Sci., 13, 25 (1965). This literature demonstrates that in a large tabular silver halide grain with a high aspect ratio, a location at which a latent image nucleus is formed is closely related to a defect in the grain. For example, U.S. Pat. Nos. 4,806,461, 5,498,516, 5,496,694, 5,476,760, and 5,567,580, and JP-A's-4-149541 and 4-149737, the disclosures of which are incorporated herein by reference, describe techniques to introduce dislocation lines into silver halide grains by controlling the introduction. Compared to tabular grains having no dislocation lines, tabular grains into which dislocation lines are introduced by these patents have superior photographic characteristics such as sensitivity and resistance to pressure. In the present invention, the use of emulsions described in these patents and the like is preferable.

In the case of tabular grains, the positions and number of dislocation lines of each grain can be properly obtained by being viewed in a direction perpendicular to the major surfaces, using a photograph of a grain taken by an electron microscope as described above. If dislocation lines are introduced into a tabular grain of the present invention, the position of introducing dislocation lines is preferably limited to a grain fringe portion, as much as possible.

In the present invention, it is preferable to introduce dislocation lines at high density into the fringe portion of a tabular grain. The fringe portion of a tabular grain has preferably 10 or more dislocation lines, more preferably, 30 or more dislocation lines, and most preferably, 50 or more dislocation lines. When dislocation lines are densely present or cross each other, it is sometimes impossible to accurately count the dislocation lines per grain. Even in these situations, however, dislocation lines can be roughly counted to such an extent as in units of 10 lines such as 10, 20, or 30 dislocation lines.

The distribution of dislocation line amounts between tabular grains of the present invention is preferably uniform in respect of the homogeneity between the grains. In an emulsion of the present invention, tabular grains containing 10 or more dislocation lines per grain in their fringe portions account for preferably 50% or more, and more preferably, 80% or more of the total number of grains. If the ratio is less than 50%, high sensitivity is difficult to obtain.

Also, in the present invention tabular silver halide grains containing 30 or more dislocation lines per grain account for preferably 50% or more, and more preferably, 80% or more of the total number of grains.

Furthermore, in tabular silver halide grains of the present invention, the positions where dislocation lines are introduced are desirably uniform. In an emulsion of the present invention, tabular silver halide grains in which dislocation lines localize only to substantially fringe portions of the grains account for preferably 50% or more, more preferably, 60% or more, and most preferably, 80% or more of the total number of grains.

In this specification, "only to substantially grain fringe portions" means that a portion other than the grain fringe portion, i.e., a grain central portion, does not contain 5 or more dislocation lines. The grain central portion is an inside region surrounded by the fringe portion when a grain is viewed in a direction perpendicular to its major surfaces.

To obtain the ratio of grains containing dislocation lines and the number of dislocation lines in the present invention, it is preferable to directly observe dislocation lines of at least 100 grains, more preferably, 200 grains, and most preferably, 300 grains.

Emulsions of the present invention and other photographic emulsions that can be used together with the emulsions of the present invention can be prepared by properly changing the methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, a neutral method, and an ammonia method can be used. In forming grains by the reaction of a soluble silver salt and a soluble halogen salt, any of the single-jet method, the double-jet method, and the combination of these methods can be used. It is also possible to use a method (so-called reverse double-jet method) of forming grains in the presence of excess silver ion. As one type of the double-jet method, a method in which the pAg of a liquid phase for producing a silver halide is maintained constant, i.e., a so-called controlled double-jet method can be used. This method makes it possible to obtain a silver halide emulsion in which the crystal shape is regular and the grain size is nearly uniform.

In some cases, it is preferable to make use of a method of adding silver halide grains already formed by precipitation to a reactor vessel for emulsion preparation, and the methods described in U.S. Pat. Nos. 4,334,012, 4,301,241, and 4,150,994, the discloses of which are herein incorporated by reference. These silver halide grains can be used as seed crystal and are also effective when supplied as a silver halide for growth. In the latter case, addition of an emulsion with a small grain size is preferable. The total amount of an emulsion can be added at one time, or an emulsion can be separately added a plurality of times or added continuously. In addition, it is sometimes effective to add grains having several different halogen compositions in order to modify the surface.

A method of converting most of or only a part of the halogen composition of a silver halide grain by a halogen conversion process is disclosed in, e.g., U.S. Pat. Nos. 3,477,852 and 4,142,900, European Patents (hereinafter also referred to as EU) 273,429 and 273,430, and West German Patent 3,819,241, the disclosers of which are incorporated herein by reference. This method is an effective grain formation method. To convert it into a silver salt that is more sparingly soluble, it is possible to add a solution of a soluble halogen or silver halide grains. The conversion can be performed at one time, separately a plurality of times, or continuously.

As a grain growth method other than the method of adding a soluble silver salt and a halogen salt at a constant concentration and a constant flow rate, it is preferable to use a grain formation method in which the concentration or the flow rate is changed, such as described in British Patent (hereinafter also referred to as GB) 1,469,480 and U.S. Pat. Nos. 3,650,757 and 4,242,445, the disclosures of which are incorporated herein by reference. Increasing the concentration or the flow rate can change the amount of a silver halide to be supplied as a linear function, a quadratic function, or a more complex function of the addition time. It is also preferable to decrease the silver halide amount to be supplied if necessary depending on the situation. Furthermore, when a plurality of soluble silver salts of different solution compositions are to be added or a plurality of soluble halogen salts of different solution compositions are to be added, a method of increasing one of the salts while decreasing the other is also effective.

A mixing vessel for reacting solutions of soluble silver salts and soluble halogen salts can be selected from those described in U.S. Pat. Nos. 2,996,287, 3,342,605, 3,415,650, and 3,785,777 and West German Patents 2,556,885 and 2,555,364, the disclosures of which are incorporated herein by reference.

A silver halide solvent is useful for the purpose of accelerating ripening. As an example, it is known to make an excess of halogen ion exist in a reactor vessel in order to accelerate ripening. Another ripening agent can also be used. The total amount of these ripening agents can be mixed in a dispersing medium placed in a reactor vessel before addition of a silver salt and a halide salt or can be introduced into the reactor vessel simultaneously with addition of a halide salt, a silver salt, and a deflocculant. Alternatively, ripening agents can be independently added in the step of adding a halide salt and a silver salt.

Examples of the ripening agent are ammonia, thiocyanate (e.g., potassium rhodanate and ammonium rhodanate), an organic thioether compound (e.g., compounds described in U.S. Pat. Nos. 3,574,628, 3,021,215, 3,057,724, 3,038,805, 4,276,374, 4,297,439, 3,704,130, and 4,782,013 and JP-A-57-104926), a thione compound (e.g., four-substituted thioureas described in JP-A-53-82408, JP-A-55-77737, and U.S. Pat. No. 4,221,863, and compounds described in JP-A-53-144319), mercapto compounds capable of accelerating growth of silver halide grains, described in JP-A-57-202531, and an amine compound (e.g., JP-A-54-100717), all the disclosures of which are incorporated herein by reference.

It is advantageous to use gelatin as a protective colloid for use in the preparation of emulsions of the present invention or as a binder for other hydrophilic colloid layers. However, another hydrophilic colloid can also be used in place of gelatin.

Examples of the hydrophilic colloid are protein such as a gelatin derivative, a graft polymer of gelatin and another high polymer, albumin, and casein; cellulose derivatives such as hydroxyethylcellulose, carboxymethylcellulose, and cellulose sulfates; sugar derivatives such as soda alginate and a starch derivative; and a variety of synthetic hydrophilic high polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, oxidated gelatin, and enzyme-processed gelatin described in Bull. Soc. Sci. Photo. Japan. No. 16, p. 30 (1966). In addition, a hydrolyzed product or an enzyme-decomposed product of gelatin can also be used.

It is preferable to wash with water an emulsion of the present invention to desalt, and disperse into a newly prepared protective colloid. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

In the formation of silver halide grains of the present invention, at least one of chalcogen sensitization including sulfur sensitization and selenium sensitization, noble metal sensitization including gold sensitization and palladium sensitization, and reduction sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization nucleus is embedded inside a grain, a type in which it is embedded in a shallow position from the surface of a grain, and a type in which it is formed on the surface of a grain. In emulsions of the present invention, the position of a chemical sensitization nucleus can be selected in accordance with the intended use. However, it is preferable to form at least one type of a chemical sensitization nucleus in the vicinity of the surface.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred.

In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to perform gold sensitization for emulsions of the present invention at the same time. An amount of a gold sensitizer is preferably $1\times10^{-4}$ to $1\times10^{-7}$ mol, and more preferably, $1\times10^{-5}$ to $5\times10^{-7}$ mol per mol of a silver halide. A preferable amount of a palladium compound is $1\times10^{-3}$ to $5\times10^{-7}$ mol per mol of a silver halide. A preferable amount of a thiocyan compound or a selenocyan compound is $5\times10^{-2}$ to $1\times10^{-6}$ mol per mol of a silver halide.

An amount of a sulfur sensitizer with respect to silver halide grains of the present invention is preferably $1\times10^{-4}$ to $1\times10^{-7}$ mol, and more preferably, $1\times10^{-5}$ to $5\times10^{-7}$ mol per mol of a silver halide.

Selenium sensitization is a preferable sensitizing method for emulsions of the present invention. Known labile selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

It is preferable to perform reduction sensitization during grain formation, after grain formation but before chemical sensitization, or during chemical sensitization, or after chemical sensitization of the silver halide emulsion.

Reduction sensitization performed in the present invention can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to combine two or more of these methods.

The method of adding reduction sensitizers is preferred in that the level of reduction sensitization can be finely adjusted. Known examples of the reduction sensitizer are stannous chloride, ascorbic acid and its derivatives, amines and polyamines, hydrazine derivatives, formamidinesulfinic acid, a silane compound, and a borane compound. In reduction sensitization of the present invention, it is possible to selectively use these reduction sensitizers or to use two or more types of compounds together. Preferable compounds as the reduction sensitizer are stannous chloride, thiourea dioxide, dimethylamineborane, and ascorbic acid and its derivatives. Although the addition amount of reduction sensitizers must be so selected as to meet the emulsion manufacturing conditions, a proper amount is $10^{-7}$ to $10^{-3}$ mol per mol of a silver halide.

The reduction sensitizer is, for example, added during grain formation by dissolving thereof to water, or organic solvents such as alcohols, glycols, ketones, esters, and amides. The reduction sensitizer can previously be added to a reaction vessel, but it is preferable to add the reduction sensitizer at a proper timing during grain growth. It is also possible to previously add the reduction sensitizer to a solution of a water-soluble silver salt or of a water-soluble alkaline halide, thereby to precipitate silver halide grains using the solutions. It is also preferable to add a solution of the reduction sensitizer at several times separately during the grain growth or add the solution for a consecutive long period.

It is preferable to use an oxidizer for silver during the process of manufacturing emulsions of the present invention. An oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced can form a silver salt hard to dissolve in water, such as a silver halide, silver sulfide, or silver selenide, or a silver salt easy to dissolve in water, such as silver nitrate.

An oxidizer for silver can be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are ozone, hydrogen peroxide and its adduct, a halogen element, an inorganic oxidizer of thiosulfonate, and an organic oxidizer of quinones. The combined use of the aforementioned reduction sensitizer and the oxidizer to silver is a preferable embodiment. The method of adding the oxidizer can be selected from the method of using the oxidizer followed by performing reduction sensitization, the vice versa thereof, or the method of making both of the oxidizer and the reduction sensitizer present at the same time. These methods can be performed at a grain formation step or a chemical sensitization step.

Photographic emulsions used in the present invention can contain various compounds in order to prevent fog during the manufacturing process, storage, or photographic processing of a lightsensitive material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly 4-hydroxy-substituted(1,3,3a,7) tetrazaindenes), and pentazaindenes.

For example, compounds described in U.S. Pat. Nos. 3,954,474 and 3,982,947 and Jpn. Pat. Appln. KOKOKU Publication No. (hereinafter referred to as JP-B-) 52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

The photographic emulsion of the present invention is preferably subjected to a spectral sensitization with methine dyes or the like, from the viewpoint that the effects desired in the present invention can be exerted. Examples of usable dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. Any of nuclei commonly used in cyanine dyes as basic heterocyclic nuclei can be applied to these dyes. Examples of such applicable nuclei include a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have a substituent on carbon atoms thereof.

Any of 5 or 6-membered heterocyclic nuclei such as a pyrazolin-5-one nucleus, a thiohydantoin nucleus, a 2-thioxazolidine-2,4-dione nucleus, a thiazolidine-2,4-dione nucleus, a rhodanine nucleus and a thiobarbituric acid nucleus can be applied as a nucleus having a ketomethylene structure to the merocyanine dye or composite merocyanine dye.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, and GB 1,344,281 and 1,507,803, JP-B's-43-4936 and 53-12375 and JP-A's-52-110618 and 52-109925.

The emulsion of the present invention may contain a dye which itself exerts no spectral sensitizing effect or a substance which absorbs substantially none of visible radiation and exhibits supersensitization, together with the above spectral sensitizing dye.

The emulsion may be doped with the spectral sensitizing dye at any stage of the process for preparing the emulsion which is known as being useful. Although the doping is most usually conducted at a stage between the completion of the chemical sensitization and the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization as described in JP-A-58-113928, and also, the spectral sensitizing dye can be added prior to the completion of silver halide grain precipitation to thereby initiate the spectral sensitization. Further, the above compound can be divided prior to addition, that is, part of the compound can be added prior to the chemical sensitization with the rest of the compound added after the chemical sensitization as taught in U.S. Pat. No. 4,225,666. Still further, the spectral sensitizing dye can be added at any stage during the formation of silver halide grains, such as the method disclosed in U.S. Pat. No. 4,183,756 and other methods.

The addition amount of the spectral sensitizing dye can range from $4\times10^{-6}$ to $8\times10^{-3}$ mol per mol of the silver halide. In the case of adopting a preferable silver halide grain size of 0.2 to 1.2 $\mu$m, the addition amount of about $5\times10^{-5}$ to $2\times10^{-3}$ is effective.

In the lightsensitive material of the present invention, it is only required that at least one lightsensitive layer be formed on a support. A typical example is a silver halide photographic lightsensitive material having, on its support, at least one lightsensitive layer constituted by a plurality of silver halide emulsion layers which are sensitive to essentially the same color but have different sensitivities. The lightsensitive layer includes a unit lightsensitive layer which is sensitive to one of blue light, green light and red light. In a multilayered silver halide color photographic lightsensitive material, these unit lightsensitive layers are generally arranged in the order of red-, green- and blue-sensitive layers from a support. However, according to the intended use, this arrangement order may be reversed, or lightsensitive layers sensitive to the same color can sandwich another lightsensitive layer sensitive to a different color.

Various non lightsensitive layers can be formed between the silver halide lightsensitive layers and as the uppermost layer and the lowermost layer. These layers may contain, e.g., couplers to be described later, DIR compounds and color-mixing inhibitors. As for a plurality of silver halide emulsion layers constituting respective unit lightsensitive layers, a two-layered structure of high- and low-speed emulsion layers can be preferably used in this order so as to the speed becomes lower toward the support as described in DE (German Patent) 1,121,470 or GB 923,045, the disclosures of which are incorporated herein by reference. Also, as described in JP-A's-57-112751, 62-200350, 62-206541 and 62-206543, the disclosures of which are incorporated herein by reference, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, the disclosure of which is incorporated herein by reference, layers can be arranged from the farthest side from a support in the order of blue-sensitive layer/GH/RH/GL/RL. Furthermore, as described in JP-A's-56-25738 and 62-63936, the disclosures of which are incorporated herein by reference, layers can be arranged from the farthest side from a support in the order of blue-sensitive layer/GL/RL/GH/RH.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464, the disclosure of which is incorporated herein by reference.

In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

To improve the color reproducibility, as described in U.S. Pat. Nos. 4,663,271, 4,705,744, and 4,707,436, and JP-A's-62-160448, and 63-89850, the disclosures of which are incorporated herein by reference, a donor layer (CL) with an interlayer effect, which has a different spectral sensitivity distribution from that of a main sensitive layer such as BL, GL, or RL, is preferably formed adjacent to, or close to, this main sensitive layer.

A silver halide used in the present invention is silver iodobromide, silver iodochloride, or silver bromochloroiodide containing about 30 mol % or less of silver iodide. A particularly preferable silver halide is silver iodobromide or silver bromochloroiodide containing about 2 to about 10 mol % of silver iodide.

Silver halide grains contained in a photographic emulsion can have regular crystals such as cubic, octahedral, or tetradecahedral crystals, irregular crystals such as spherical or tabular crystals, crystals having crystal defects such as twin planes, or composite shapes thereof.

A silver halide can consist of fine grains having a grain size of about 0.2 $\mu$m or less or large grains having a projected area diameter of about 10 $\mu$m, and an emulsion can be either a polydisperse or monodisperse emulsion.

A silver halide photographic emulsion which can be used in the present invention can be prepared by methods described in, e.g., Research Disclosure (RD) No. 17643 (December, 1978), pp. 22 and 23, "I. Emulsion preparation and types", and RD No. 18716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, e.g., U.S. Pat. Nos. 3,574,628 and 3,655,394, and GB1,413,748 are also preferable.

Tabular grains having an aspect ratio of about 3 or more can also be used in the present invention. Such tabular grains can be easily prepared by methods described in Gutoff, "Photographic Science and Engineering", Vol. 14, pp. 248 to 257 (1970); and U.S. Pat. Nos. 4,434,226, 4,414,310, 4,433,048, and 4,439,520, and GB2,112,157.

A crystal structure can be uniform, can have different halogen compositions in the interior and the surface layer thereof, or can be a layered structure. Alternatively, a silver halide having a different composition can be bonded by an epitaxial junction or a compound other than a silver halide such as silver rhodanide or lead oxide can be bonded. A mixture of grains having various types of crystal shapes can also be used.

The above emulsion can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740. A method of preparing this core/shell internal latent image type emulsion is described in JP-A-59-133542. Although the thickness of a shell of this emulsion depends on, e.g., development conditions, it is preferably 3 to 40 nm, and most preferably, 5 to 20 nm.

A silver halide emulsion layer is normally subjected to physical ripening, chemical ripening, and spectral sensitization steps before it is used. Additives for use in these steps are described in RD Nos. 17643, 18716, and 307105, and they are summarized in a table to be presented later.

In a lightsensitive material of the present invention, it is possible to mix, in a single layer, two or more types of emulsions different in at least one of characteristics of a photosensitive silver halide emulsion, i.e., a grain size, grain size distribution, halogen composition, grain shape, and sensitivity.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in sensitive silver halide emulsion layers and/or essentially non-sensitive hydrophilic colloid layers. The internally fogged or surface-fogged silver halide grain means a silver halide grain which can be developed uniformly (non-imagewise) regardless of whether the location is a non-exposed portion or an exposed portion of the photosensitive material. A method of preparing the internally fogged or surface-fogged silver halide grain is described in U.S. Pat. No. 4,626,498 and JP-A-59-214852. A silver halide which forms the core of an internally fogged core/shell type silver halide grain can have a different halogen composition. As the internally fogged or surface-fogged silver halide, any of silver chloride, silver chlorobromide, silver bromoiodide, and silver bromochloroiodide can be used. The average grain size of these fogged silver halide grains is preferably 0.01 to 0.75 $\mu$m, and most preferably, 0.05 to 0.6 $\mu$m. The grain shape can be a regular grain shape. Although the emulsion can be a polydisperse emulsion, it is preferably a monodisperse emulsion (in which at least 95% in mass or number of grains of silver halide grains have grain sizes falling within the range of ±40% of the average grain size).

In the present invention, it is preferable to use a non-sensitive fine grain silver halide. The non-sensitive fine grain silver halide consists of silver halide fine grains which are not exposed during imagewise exposure for obtaining a dye image and are not essentially developed during development. These silver halide grains are preferably not fogged in advance. In the fine grain silver halide, the content of silver bromide is 0 to 100 mol %, and silver chloride and/or silver iodide can be added if necessary. The fine grain silver halide preferably contains 0.5 to 10 mol % of silver iodide. The average grain size (the average value of equivalent-circle diameters of projected areas) of the fine grain silver halide is preferably 0.01 to 0.5 $\mu$m, and more preferably, 0.02 to 0.2 $\mu$m.

The non-sensitive fine grain silver halide can be prepared following the same procedures as for a common lightsensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine grain silver halide grain-containing layer.

The silver coating amount of a lightsensitive material of the present invention is preferably 3.5 g/m$^2$ to 8.5 g/m$^2$, and more preferably, 4.0 g/m$^2$ to 8.0 g/m$^2$.

Photographic additives usable in the present invention are also described in RD's, the disclosures of which are incorporated herein by reference, and the relevant portions are summarized in the following table.

| Types of additives | RD17643 | RD18716 | RD307105 |
|---|---|---|---|
| 1. Chemical sensitizers | page 23 | page 648 right column | page 866 |
| 2. Sensitivity increasing agents | | page 648 right column | |
| 3. Spectral sensitizers, super-sensitizers | pages 23–24 | page 648, right column to page 649, right column | pages 866–868 |
| 4. Brighteners | page 24 | page 647, right column | page 868 |
| 5. Light absorbents, filter dyes, ultraviolet absorbents | pages 25–26 | page 649, right column to page 650, left column | page 873 |
| 6. Binders | page 26 | page 651, left column | pages 873–874 |
| 7. Plasticizers, lubricants | page 27 | page 650, right column | page 876 |
| 8. Coating aids, surfactants | pages 26–27 | page 650, right column | pages 875–876 |
| 9. Antistatic agents | page 27 | page 650, right column | pages 876–877 |
| 10. Matting agents | | | pages 878–879. |

Various dye forming couplers can be used in a lightsensitive material of the present invention, and the following couplers disclosed in the documents, the disclosures of which are incorporated herein by reference, are particularly preferable.

Yellow couplers: couplers represented by formulas (I) and (II) in EP502,424A; couplers (particularly Y-28 on page 18) represented by formulas (1) and (2) in EP513,496A; a coupler represented by formula (I) in claim 1 of EP568,037A; a coupler represented by formula (I) in column 1, lines 45 to 55 of U.S. Pat. No. 5,066,576; a coupler represented by formula (I) in paragraph 0008 of JP-A-4-274425; couplers (particularly D-35 on page 18) described in claim 1 on page 40 of EP498,381A1; couplers (particularly Y-1 (page 17) and Y-54 (page 41)) represented by formula (Y) on page 4 of EP447,969A1; and couplers (particularly II-17 and II-19 (column 17), and II-24 (column 19)) represented by formulas (II) to (IV) in column 7, lines 36 to 58 of U.S. Pat. No. 4,476,219.

Magenta couplers: JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP456,257; M-4 and M-6 (page 26), and M-7 (page 27) in EP486,965; M-45 (page 19) in EP571,959A; (M-1) (page 6) in JP-A-5-204106; and M-22 in paragraph 0237 of JP-A-4-362631.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of JP-A-6-67385.

Polymer couplers: P-1 and P-5 (page 11) in JP-A-2-44345.

Couplers for forming a colored dye with a proper diffusibility are preferably those described in U.S. Pat. No. 4,366,237, GB2,125,570, EP96,873B, and DE3,234,533. Couplers for correcting unnecessary absorption of a colored dye are preferably yellow colored cyan couplers (particularly YC-86 on page 84) represented by formulas (CI), (CII), (CIII), and (CIV) described on page 5 of EP456,257A1; yellow colored magenta couplers ExM-7 (page 202), EX-1 (page 249), and EX-7 (page 251) in EP456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers (particularly compound examples on pages 36 to 45) represented by formula (A) in claim 1 of WO92/11575.

Examples of a compound (including a coupler) which reacts with an oxidized form of a developing agent and releases a photographically useful compound residue are as follows.

Development inhibitor release compounds: compounds (particularly T-101 (page 30), T-104 (page 31), T-113 (page 36), T-131 (page 45), T-144 (page 51), and T-158 (page 58)) represented by formulas (I), (II), (III), (IV) described on page 11 of EP378,236A1, compounds (particularly D-49 (page 51)) represented by formula (I) described on page 7 of EP436,938A2, compounds (particularly (23) (page 11)) represented by formula (1) in EP568,037A, and compounds (particularly I-(1) on page 29) represented by formulas (I), (II), and (III) described on pages 5 and 6 of EP440,195A2;

bleaching accelerator-releasing compounds: compounds (particularly (60) and (61) on page 61) represented by formulas (I) and (I') on page 5 of EP310,125A2, and compounds (particularly (7) (page 7)) represented by formula (I) in claim 1 of JP-A-6-59411;

ligand-releasing compounds: compounds (particularly compounds in column 12, lines 21 to 41) represented by LIG-X described in claim 1 of U.S. Pat. No. 4,555,478;

leuco dye-releasing compounds: compounds 1 to 6 in columns 3 to 8 of U.S. Pat. No. 4,749,641;

fluorescent dye release compounds: compounds (particularly compounds 1 to 11 in columns 7 to 10) represented by COUP-DYE in claim 1 of U.S. Pat. No. 4,774,181;

development accelerator or fogging agent-releasing compounds: compounds (particularly (I-22) in column 25) represented by formulas (1), (2), and (3) in column 3 of U.S. Pat. No. 4,656,123, and ExZK-2 on page 75, lines 36 to 38 of EP450,637A2;

compounds which release a group which does not function as a dye unless it splits off: compounds (particularly Y-1 to Y-19 in columns 25 to 36) represented by formula (I) in claim 1 of U.S. Pat. No. 4,857,447.

Preferable examples of additives other than couplers are as follows.

Dispersants of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of an oil-soluble organic compound: latexes described in U.S. Pat. No. 4,199,363; developing agent oxidized form scavengers: compounds (particularly I-(1), I-(2), I-(6), and I-(12) (columns 4 and 5)) represented by formula (I) in column 2, lines 54 to 62 of U.S. Pat. No. 4,978,606, and formulas (particularly a compound 1 (column 3)) in column 2, lines 5 to 10 of U.S. Pat. No. 4,923,787; stain inhibitors: formulas (I) to (III) on page 4, lines 30 to 33, particularly I-47, I-72, III-1, and III-27 (pages 24 to 48) in EP298321A; discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP298321A, II-1 to III-23, particularly III-10 in columns 25 to 38 of U.S. Pat. No. 5,122,444, I-1 to III-4, particularly II-2 on pages 8 to 12 of EP471347A, and A-1 to A-48, particularly A-39 and A-42 in columns 32 to 40 of U.S. Pat. No. 5,139,931; materials which reduce the use amount of a color enhancer or a color amalgamation inhibitor: I-1 to II-15, particularly I-46 on pages 5 to 24 of EP411324A;

formalin scavengers: SCV-1 to SCV-28, particularly SCV-8 on pages 24 to 29 of EP477932A; film hardeners: H-1, H-4, H-6, H-8, and H-14 on page 17 of JP-A-1-214845, compounds (H-1 to H-54) represented by formulas (VII) to (XII) in columns 13 to 23 of U.S. Pat. No. 4,618,573, compounds (H-1 to H-76), particularly H-14 represented by formula (6) on page 8, lower right column of JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7 of U.S. Pat. No. 5,019,492; antiseptic agents and mildewproofing agents: I-1 to III-43, particularly II-1, II-9, II-10, II-18, and III-25 in columns 3 to 15 of U.S. Pat. No. 4,923,790; stabilizers and antifoggants: I-1 to (14), particularly I-1, I-60, (2), and (13) in columns 6 to 16 of U.S. Pat. No. 4,923,793, and compounds 1 to 65, particularly the compound 36 in columns 25 to 32 of U.S. Pat. No. 4,952,483; chemical sensitizers: triphenylphosphine selenide and a compound 50 in JP-A-5-40324;

dyes: a-1 to b-20, particularly a-1, a-12, a-18, a-27, a-35, a-36, and b-5 on pages 15 to 18 and V-1 to V-23, particularly V-1 on pages 27 to 29 of JP-A-3-156450, F-I-1 to F-II-43, particularly F-I-11 and F-II-8 on pages 33 to 55 of EP445627A, III-1 to III-36, particularly III-1 and III-3 on pages 17 to 28 of EP457153A, fine crystal dispersions of Dye-1 to Dye-124 on pages 8 to 26 of WO88/04794, compounds 1 to 22, particularly the compound 1 on pages 6 to 11 of EP319999A, compounds D-1 to D-87 (pages 3 to 28) represented by formulas (1) to (3) in EP519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788; UV absorbents: compounds (18b) to (18r) and 101 to 427 (pages 6 to 9) represented by formula (1) in JP-A-46-3335, compounds (3) to (66) (pages 10 to 44) represented by formula (I) and compounds HBT-1 to HBT-10 (page 14) represented by formula (III) in EP520938A, and compounds (1) to (31) (columns 2 to 9) represented by formula (1) in EP521823A.

The present invention can be applied to various color lightsensitive materials such as color negative films for general purposes or movies, color reversal films for slides or television, color paper, color positive films, and color reversal paper. The present invention is also suited to film units with lens described in JP-B-2-32615 and Jpn. UM Appln. KOKOKU Publication No. 3-39784.

A support which can be suitably used in the present invention is described in, e.g., RD. No. 17643, page 28, RD. No. 18716, page 647, right column to page 648, left column, and RD. No. 307105, page 879.

In a lightsensitive material of the present invention, the total film thickness of all hydrophilic colloid layers on the side having emulsion layers is preferably 28 μm or less, more preferably, 23 μm or less, most preferably, 18 μm or less, and particularly preferably, 16 μm or less. A film swell speed $T_{1/2}$ is preferably 30 sec or less, and more preferably, 20 sec or less. $T_{1/2}$ is defined as a time which the film thickness requires to reach ½ of a saturation film thickness which is 90% of a maximum swell film thickness reached when processing is performed by using a color developer at 30° C. for 3 min and 15 sec. A film thickness means the thickness of a film measured under moisture conditioning at a temperature of 25° C. and a relative humidity of 55% (two days). $T_{1/2}$ can be measured by using a swell meter described in Photogr. Sci. Eng., A. Green et al., Vol. 19, No. 2, pp. 124 to 129. $T_{1/2}$ can be adjusted by adding a film hardening agent to gelatin as a binder or changing aging conditions after coating. The swell ratio is preferably 150 to 400%. The swell ratio can be calculated from the maximum swell film thickness under the conditions mentioned above by using the formula: (maximum swell film thickness−film thickness)/film thickness.

In a lightsensitive material of the present invention, hydrophilic colloid layers (called back layers) having a total dried film thickness of 2 to 20 μm are preferably formed on the side opposite to the side having emulsion layers. The back layers preferably contain, e.g., the aforementioned light absorbents, filter dyes, ultraviolet absorbents, antistatic agents, film hardeners, binders, plasticizers, lubricants, coating aids, and surfactants. The swell ratio of the back layers is preferably 150 to 500%.

A lightsensitive material according to the present invention can be developed by conventional methods described in RD. No. 17643, pp. 28 and 29, RD. No. 18716, page 651, left to right columns, and RD No. 307105, pp. 880 and 881.

Color negative film processing solutions used in the present invention will be described below. Compounds described in JP-A-4-121739, page 9, upper right column, line 1 to page 11, lower left column, line 4 can be used in a color developer of the present invention. As a color developing agent used when particularly rapid processing is to be performed, 2-methyl-4-[N-ethyl-N-(2-hydroxyethyl) amino]aniline, 2-methyl-4-[N-ethyl-N-(3-hydroxypropyl) amino]aniline, or 2-methyl-4-[N-ethyl-N-(4-hydroxybutyl) amino]aniline is preferable.

The use amount of any of these color developing agents is preferably 0.01 to 0.08 mol, more preferably, 0.015 to 0.06 mol, and most preferably, 0.02 to 0.05 mol per liter (to be referred to as "L" hereinafter) of a color developer. Also, a replenisher of a color developer preferably contains a color developing agent at a concentration 1.1 to 3 times, particularly 1.3 to 2.5 times the above concentration.

As a preservative of a color developer, hydroxylamine can be extensively used. If higher preservability is necessary, the use of a hydroxylamine derivative having a substituent such as an alkyl group, hydroxylalkyl group, sulfoalkyl group, or carboxyalkyl group is preferable. Specific examples thereof are N,N-di(sulfoethyl)hydroxylamine, monomethylhydroxylamine, dimethylhydroxylamine, monoethylhydroxylamine, diethylhydroxylamine, and N,N-di(carboxylethyl)hydroxylamine. Of these derivatives, N,N-di(sulfoethyl)hydroxylamine is particularly preferable. Although these derivatives can be used together with hydroxylamine, it is preferable to use one or two or more types of these derivatives instead of hydroxylamine.

The use amount of a preservative is preferably 0.02 to 0.2 mol, more preferably, 0.03 to 0.15 mol, and most preferably, 0.04 to 0.1 mol per L. As in the case of a color developing agent, a replenisher preferably contains a preservative at a concentration 1.1 to 3 times that of a mother solution (processing tank solution).

A color developer contains sulfite as an agent for preventing an oxide of a color developing agent from changing into tar. The use amount of this sulfite is preferably 0.01 to 0.05 mol, and more preferably, 0.02 to 0.04 mol per L. Sulfite is preferably used at a concentration 1.1 to 3 times the above concentration in a replenisher.

The pH of a color developer is preferably 9.8 to 11.0, and more preferably 10.0 to 10.5. In a replenisher, the pH is preferably set to be higher by 0.1 to 1.0 than these values. To stably maintain this pH, a known buffering agent such as carbonate, phosphate, sulfosalicylate, or borate is used.

The replenishment rate of a color developer is preferably 80 to 1,300 milliliters (to be also referred to as "mL" hereinafter) per $m^2$ of a lightsensitive material. However, the replenishment rate is preferably smaller in order to reduce environmental pollution. For example, the replenishment rate is preferably 80 to 600 mL, and more preferably, 80 to 400 mL.

The bromide ion concentration in the color developer is usually 0.01 to 0.06 mol per L. However, this bromide ion concentration is preferably set at 0.015 to 0.03 mol per L in order to suppress fog and improve discrimination and graininess while maintaining sensitivity. To set the bromide ion concentration in this range, it is only necessary to add bromide ions calculated by the following equation to a replenisher. If C takes a negative value, however, no bromide ions are preferably added to a replenisher.

$$C=A-W/V$$

where

C: a bromide ion concentration (mol/L) in a color developer replenisher

A: a target bromide ion concentration (mol/L) in a color developer

W: an amount (mol) of bromide ions dissolving into a color developer from 1 $m^2$ of a lightsensitive material when the sensitive material is color-developed V: a replenishment rate (L) of a color developer replenisher for 1 $m^2$ of a lightsensitive material As a method of increasing the sensitivity when the replenishment rate is decreased or high bromide ion concentration is set, it is preferable to use a development accelerator such as pyrazolidones represented by 1-phenyl-3-pyrazolidone and 1-phenyl-2-methyl-2-hydroxylmethyl-3-pyrazolidone, or a thioether compound represented by 3,6-dithia-1,8-octandiol.

Compounds and processing conditions described in JP-A-4-125558, page 4, lower left column, line 16 to page 7, lower left column, line 6 can be applied to a processing solution having bleaching capacity in the present invention. This bleaching agent preferably has an oxidation-reduction potential of 150 mV or more. Preferable practical examples of the bleaching agent are described in JP-A's-5-72694 and 5-173312. In particular, 1,3-diaminopropane tetraacetic acid and ferric complex salt of a compound as practical example 1 in JP-A-5-173312, page 7 are preferable.

To improve the biodegradability of a bleaching agent, it is preferable to use compound ferric complex salts described in JP-A's-4-251845, and 4-268552, EP588,289, EP591,934, and JP-A-6-208213, as the bleaching agent. The concentration of any of these bleaching agents is preferably 0.05 to 0.3 mol per L of a solution having bleaching capacity. To secure a bleaching function and reduce the amount of waste to the environment, the concentration is preferably designed to be 0.1 to 0.15 mol per L of the solution having bleaching capacity. When the solution having bleaching capacity is a bleaching solution, preferably 0.2 to 1 mol, and more preferably, 0.3 to 0.8 mol of a bromide is added per L.

A replenisher of the solution having bleaching capacity basically contains components at concentrations calculated by the following equation. This makes it possible to maintain the concentrations in a mother solution constant.

$$C_R=C_T\times(V_1+V_2)/V_1+C_P$$

where $C_R$: concentrations of components in a replenisher $C_T$: concentrations of components in a mother solution (processing tank solution)

$C_P$: concentrations of components consumed during processing $V_1$: a replenishment rate (mL) of a replenisher having bleaching capacity per $m^2$ of a lightsensitive material $V_2$: an amount (mL) carried over from a pre-bath per $m^2$ of a lightsensitive material Additionally, a bleaching solution preferably contains a pH buffering agent, and more preferably contains dicarboxylic acid with little odor such as succinic acid, maleic acid, malonic acid, glutaric acid, adipic acid and the like. Also, the use of known bleaching accelerators described in JP-A-53-95630, RD No. 17129, and U.S. Pat. No. 3,893,858 is preferable.

It is preferable to replenish 50 to 1,000 mL of a bleaching replenisher to a bleaching solution per $m^2$ of a lightsensitive material. The replenishment rate is more preferably 80 to 500 mL, and most preferably, 100 to 300 mL. Aeration of a bleaching solution is also preferable.

Compounds and processing conditions described in JP-A-4-125558, page 7, lower left column, line 10 to page 8, lower right column, line 19 can be applied to a processing solution with fixing capacity.

To improve the fixing rate and preservability, compounds represented by formulas (I) and (II) described in JP-A-6-301169 are preferably added singly or together to a processing solution with fixing capacity. To improve the preservability, the use of sulfinic acid such as p-toluenesulfinate described in JP-A-1-224762 is also preferable. To improve the desilvering characteristics, ammonium is preferably used as cation in a solution with bleaching capacity or a solution with fixing capacity. However, the amount of ammonium is preferably reduced, or zero, to reduce environmental pollution.

In the bleaching, bleach-fixing, and fixing steps, it is particularly preferable to perform jet stirring described in JP-A-1-309059.

The replenishment rate of a replenisher in the bleach-fixing or fixing step is preferably 100 to 1,000 mL, more preferably, 150 to 700 mL, and most preferably, 200 to 600 mL per $m^2$ of a lightsensitive material.

In the bleach-fixing or fixing step, an appropriate silver collecting apparatus is preferably installed either in-line or off-line to collect silver. When the apparatus is installed in-line, processing can be performed while the silver concentration in a solution is reduced, so the replenishment rate can be reduced. It is also preferable to install the apparatus off-line to collect silver and reuse the residual solution as a replenisher.

The bleach-fixing or fixing step can be performed by using a plurality of processing tanks, and these tanks are preferably cascaded to form a multistage counterflow system. To balance the size of a processor, a two-tank cascade system is generally efficient. The processing time ratio of the front tank to the rear tank is preferably 0.5:1 to 1:0.5, and more preferably, 0.8:1 to 1:0.8.

In a bleach-fixing or fixing solution, the presence of free chelating agents which are not metal complexes is preferable to improve the preservability. As these chelating agents, the use of the biodegradable chelating agents previously described in connection to a bleaching solution is preferable.

Contents described in aforementioned JP-A-4-125558, page 12, lower right column, line 6 to page 13, lower right column, line 16 can be preferably applied to the washing and stabilization steps. To improve the safety of the work environment, it is preferable to use azolylmethylamines described in EP504,609 and EP519,190 or N-methylolazoles described in JP-A-4-362943 instead of formaldehyde in a stabilizer and to make a magenta coupler divalent to form a solution of surfactant containing no image stabilizing agent such as formaldehyde. To reduce adhesion of dust to a magnetic recording layer formed on a lightsensitive material, a stabilizer described in JP-A-6-289559 can be preferably used.

The replenishment rate of washing water and a stabilizer is preferably 80 to 1,000 mL, more preferably, 100 to 500 mL, and most preferably, 150 to 300 mL per $m^2$ of a lightsensitive material in order to maintain the washing and stabilization functions and at the same time reduce the waste liquors for environmental protection. In processing performed with this replenishment rate, it is preferable to prevent the propagation of bacteria and mildew by using known mildewproofing agents such as thiabendazole, 1,2-benzoisothiazoline-3-one, and 5-chloro-2-methylisothiazoline-3-one, antibiotics such as gentamicin, and water deionized by an ion exchange resin or the like. It is more effective to use deionized water together with a mildewproofing agent or an antibiotic.

The replenishment rate of a solution in a washing water tank or stabilizer tank is preferably reduced by performing reverse permeable membrane processing described in JP-A's-3-46652, 3-53246, 3-55542, 3-121448, and 3-126030. A reverse permeable membrane used in this processing is preferably a low-pressure reverse permeable membrane.

In the processing of the present invention, it is particularly preferable to perform processing solution evaporation correction disclosed in Journal of Technical Disclosure No. 94-4992. In particular, a method of performing correction on the basis of (formula-1) on page 2 by using temperature and humidity information of an environment in which a processor is installed is preferable. Water for use in this evaporation correction is preferably taken from the washing water replenishment tank. If this is the case, deionized water is preferably used as the washing replenishing water.

Processing agents described in aforementioned Journal of Technical Disclosure No. 94-4992, page 3, right column, line 15 to page 4, left column, line 32 are preferably used in the present invention. As a processor for these processing agents, a film processor described on page 3, right column, lines 22 to 28 is preferable.

Practical examples of processing agents, automatic processors, and evaporation correction methods suited to practicing the present invention are described in the same Journal of Technical Disclosure No. 94-4992, page 5, right column, line 11 to page 7, right column, last line.

Processing agents used in the present invention can be supplied in any form: a liquid agent having the concentration of a solution to be used, concentrated liquid agent, granules, powder, tablets, paste, and emulsion. Examples of such processing agents are a liquid agent contained in a low-oxygen permeable vessel disclosed in JP-A-63-17453, vacuum-packed powders and granules disclosed in JP-A's-4-19655 and 4-230748, granules containing a water-soluble polymer disclosed in JP-A-4-221951, tablets disclosed in JP-A's-51-61837 and 6-102628, and a paste disclosed in PCT National Publication No. 57-500485. Although any of these processing agents can be preferably used, the use of a liquid adjusted to have the concentration of a solution to be used is preferable for the sake of convenience in use.

As a vessel for containing these processing agents, polyethylene, polypropylene, polyvinylchloride, polyethyleneterephthalate, and nylon are used singly or as a composite material. These materials are selected in accordance with the level of necessary oxygen permeability. For a readily oxidizable solution such as a color developer, a low-oxygen permeable material is preferable. More specifically, polyethyleneterephthalate or a composite material of polyethylene and nylon is preferable. A vessel made of any of these materials preferably has a thickness of 500 to 1,500 $\mu$m and an oxygen permeability of 20 mL/$m^2$.24 hrs.atm or less.

Color reversal film processing solutions used in the present invention will be described below. Processing for a color reversal film is described in detail in Aztech Ltd., Known Technology No. 6 (1991, April 1), page 1, line 5 to page 10, line 5 and page 15, line 8 to page 24, line 2, and any of the contents can be preferably applied. In this color reversal film processing, an image stabilizing agent is contained in a control bath or a final bath. Preferable examples of this image stabilizing agent are formalin, sodium formaldehyde-bisulfite, and N-methylolazole. Sodium formaldehyde-bisulfite or N-methylolazole is preferable in terms of work environment, and N-methyloltriazole is particularly preferable as N-methylolazole. The contents pertaining to a color developer, bleaching solution, fixing solution, and washing water described in the color negative film processing can be preferably applied to the color reversal film processing.

Preferable examples of color reversal film processing agents containing the above contents are an E-6 processing agent manufactured by Eastman Kodak Co. and a CR-56 processing agent manufactured by Fuji Photo Film Co., Ltd.

A color photosensitive material of the present invention is also suitably used as a negative film for an advanced photo system (to be referred to as an APS hereinafter). Examples are NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series represented by the EPION 300Z. A color photosensitive film of the present invention is also suited as a film with lens such as Fuji Film FUJICOLOR UTSURUNDESU (Quick Snap) SUPER SLIM.

A photographed film is printed through the following steps in a miniature laboratory system.

(1) Reception (an exposed cartridge film is received from a customer)
(2) Detaching step (the film is transferred from the cartridge to an intermediate cartridge for development)
(3) Film development
(4) Reattaching step (the developed negative film is returned to the original cartridge)
(5) Printing (prints of three types C, H, and P and an index print are continuously automatically printed on color paper [preferably Fuji Film SUPER FA8])
(6) Collation and shipment (the cartridge and the index print are collated by an ID number and shipped together with the prints)

As these systems, the Fuji Film MINILABO CHAMPION SUPER FA-298, FA-278, FA-258, FA-238 are preferable. Examples of a film processor are the FP922AL, FP562B, FP562BL, FP362B, and FP3622BL, and a recommended processing chemical is the FUJICOLOR JUST-IT CN-16L. Examples of a printer processor are the PP3008AR, PP3008A, PP1828AR, PP1828A, PP1258AR, PP1258A, PP728AR, and PP728A, and a recommended processing chemical is the FUJICOLOR JUST-IT CP-47L. A detacher used in the detaching step and a reattacher used in the reattaching step are preferably the Fuji Film DT200 or DT100 and AT200 or AT100, respectively.

The APS can also be enjoyed by PHOTO JOY SYSTEM whose main component is the Fuji Film Aladdin 1000 digital image work station. For example, a developed APS cartridge film is directly loaded into the Aladdin 1000, or image information of a negative film, positive film, or print is input to the Aladdin 1000 by using the FE-550 35-mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film Photo Player AP-1. Image information can also be continuously input to a personal computer by loading a developed APS cartridge film into the Fuji Film Photo Scanner AS-1. The Fuji Film Photo Vision FV-10 or FV-5 can be used to input a film, print, or three-dimensional object. Furthermore, image information recorded in a floppy disk, Zip disk, CD-R, or hard disk can be variously processed on a computer by using the Fuji Film Photo Factory application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferable.

The magnetic recording layer for use in the present invention will be described below.

The lightsensitive material of the present invention can have a magnetic recording layer on a side (hereinafter referred to as "back side") of a support opposite to the side having emulsion layers. The magnetic recording layer used in the present invention is obtained by coating on a support with a water-base or organic solvent coating liquid having magnetic material grains dispersed in a binder.

Suitable magnetic material grains used in the present invention can be composed of any of ferromagnetic iron oxides such as $\gamma Fe_2O_3$, Co coated $\gamma Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated $\gamma Fe_2O_3$ are preferred. The configuration thereof may be any of acicular, rice grain, spherical, cubic and plate shapes. The specific surface area is preferably at least 20 $m^2/g$, more preferably at least 30 $m^2/g$ in terms of $S_{BET}$. The saturation magnetization ($\sigma s$) of the ferromagnetic material preferably ranges from $3.0\times10^4$ to $3.0\times10^5$ A/m, more preferably from $4.0\times10^4$ to $2.5\times10^5$ A/m. The ferromagnetic material grains may have their surface treated with silica and/or alumina or an organic material. Further, the magnetic material grains may have their surface treated with a silane coupling agent or a titanium coupling agent as described in JP-A-6-161032. Still further, use can be made of magnetic material grains having their surface coated with an organic or inorganic material as described in JP-A's-4-259911 and 5-81652.

The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 2 thousand to 1 million. For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. of these, cellulose di(tri)acetate is especially preferred. The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyalcohols (e.g., reaction product of 3 mol of tolylene diisocyanate and 1 mol of trimethylolpropane), and polyisocyanates produced by condensation of these isocyanates, as described in, for example, JP-A-6-59357.

The method of dispersing the magnetic material in the above binder preferably comprises using a kneader, a pin type mill and an annular type mill either individually or in combination as described in JP-A-6-35092. Dispersants listed in JP-A-5-088283 and other common dispersants can be used. The thickness of the magnetic recording layer ranges from 0.1 to 10 $\mu$m, preferably 0.2 to 5 $\mu$m, and more preferably from 0.3 to 3 $\mu$m. The mass ratio of magnetic material grains to binder is preferably in the range of 0.5:100 to 60:100, more preferably 1:100 to 30:100. The coating amount of magnetic material grains ranges from 0.005 to 3 $g/m^2$, preferably from 0.01 to 2 $g/m^2$, and more preferably from 0.02 to 0.5 $g/m^2$. The transmission yellow density of the magnetic recording layer is preferably in the range of 0.01 to 0.50, more preferably 0.03 to 0.20, and most preferably 0.04 to 0.15. The magnetic recording layer can be applied to the back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating liquids set forth in JP-A-5-341436 are preferably used.

The magnetic recording layer may also be provided with, for example, lubricity enhancing, curl regulating, antistatic, sticking preventive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as mentioned above and, preferably, the same as the that of the magnetic recording layer. The lightsensitive material having the magnetic recording layer is described in U.S. Pat. Nos. 5,336,589, 5,250,404, 5,229,259, and 5,215,874 and EP No. 466,130.

The polyester support for use in the present invention will be described below. Particulars thereof together with the below mentioned lightsensitive material, processing, cartridge and working examples are specified in Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol % are especially preferred. Polyethylene 2,6-naphthalate is most preferred. The average molecular weight thereof ranges from approximately 5,000 to 200,000. The Tg of the polyester of the present invention is at least 50° C., preferably at least 90° C.

The polyester support is subjected to heat treatment at a temperature of from 40° C. to less than Tg, preferably from Tg minus 20° C. to less than Tg, in order to suppress curling. This heat treatment may be conducted at a temperature held constant within the above temperature range or may be conducted while cooling. The period of heat treatment ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent or a lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

In the present invention, a surface treatment is preferably conducted for bonding a support and a lightsensitive material constituting layer to each other. The surface treatment is, for example, a surface activating treatment such as chemical treatment, mechanical treatment, corona discharge treatment, flame treatment, ultraviolet treatment, high frequency treatment, glow discharge treatment, active plasma treatment, laser treatment, mixed acid treatment or ozone oxidation treatment. Of these surface treatments, ultraviolet irradiation treatment, flame treatment, corona treatment and glow treatment are preferred.

The lightsensitive material of the invention may have a subbing layer on at least one of the emulsion layer side and the back side. The subbing layer may be composed of a single layer or two or more layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose and gelatin. Resorcin or p-chlorophenol is used as a support swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-S-triazine), an epichlorohydrin resin or an active vinyl sulfone compound can be used in the subbing layer. Also, $SiO_2$, $TiO_2$, inorganic fine grains or polymethyl methacrylate copolymer fine grains (0.01 to 10 $\mu$m) may be incorporated therein as a matting agent.

Further, an antistatic agent is preferably used in lightsensitive material of the present invention. Examples of suitable antistatic agents include carboxylic acids and carboxylic salts, sulfonic acid salt containing polymers, cationic polymers and ionic surfactant compounds.

Most preferred as the antistatic agent are fine grains of at least one crystalline metal oxide selected from among ZnO, $TiO_2$, $SnO_2$, $Al_2O_3$, $In_2O_3$, $SiO_2$, MgO, BaO, $MoO_3$ and $V_2O_5$ having a volume resistivity of $10^7$ Ω.cm or less, preferably $10^5$ Ω.cm or less, and having a grain size of 0.001 to 1.0 $\mu$m or a composite oxide thereof (Sb, P, B, In, S, Si, C, etc.) and fine grains of sol form metal oxides or composite oxides thereof. The content thereof in the lightsensitive material is preferably in the range of 5 to 500 mg/m$^2$, more preferably 10 to 350 mg/m$^2$. The ratio of amount of conductive crystalline oxide or composite oxide thereof to binder (oxide/binder) is preferably in the range of 1/300 to 100/1, more preferably 1/100 to 100/5.

It is preferred that the lightsensitive material of the present invention have lubricity. The lubricant containing layer is preferably provided on both the lightsensitive layer side and the back side. Preferred lubricity ranges from 0.25 to 0.01 in terms of dynamic friction coefficient. The measured lubricity is a value obtained by conducting a carriage on a stainless steel ball of 5 mm in diameter at 60 cm/min (25° C., 60% RH). In this evaluation, value of approximately the same level is obtained even when the opposite material is replaced by the lightsensitive layer side.

The lubricant which can be used in the present invention is, for example, a polyorganosiloxane, a higher fatty acid amide, a higher fatty acid metal salt or an ester of higher fatty acid and higher alcohol. Examples of suitable polyorganosiloxanes include polydimethylsiloxane, polydiethylsiloxane, polystyrylmethylsiloxane and polymethylphenylsiloxane. The lubricant is preferably added to the back layer or the outermost layer of the emulsion layer. Especially, polydimethylsiloxane and an ester having a long chain alkyl group are preferred.

A matting agent is preferably used in the light-sensitive material of the present invention. Although the matting agent may be used on the emulsion side or the back side indiscriminately, it is especially preferred that the matting agent be added to the outermost layer of the emulsion side. The matting agent may be soluble in the processing solution or insoluble in the processing solution, and it is preferred to use the soluble and insoluble matting agents in combination. For example, polymethyl methacrylate, poly(methyl methacrylate/methacrylic acid) (9/1 or 5/5 in molar ratio) and polystyrene grains are preferred. The grain size thereof preferably ranges from 0.8 to 10 $\mu$m. Narrow grain size distribution thereof is preferred, and it is desired that at least 90% of the whole number of grains be included in the range of 0.9 to 1.1 times the average grain size. Moreover, for enhancing the mat properties, it is preferred that fine grains of 0.8 $\mu$m or less be simultaneously added, which include, for example, fine grains of polymethyl methacrylate (0.2 $\mu$m), poly(methyl methacrylate/methacrylic acid) (9/1 in molar ratio, 0.3 $\mu$m), polystyrene (0.25 $\mu$m) and colloidal silica (0.03 $\mu$m).

The film patrone employed in the present invention will be described below. The main material composing the patrone for use in the present invention may be a metal or a synthetic plastic.

Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A's-1-312537 and 1-312538. The resistance thereof at 25° C. in 25% RH is preferably $10^{12}$ Ω or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 $cm^3$ or less, more preferably 25 $cm^3$ or less. The mass of the plastic used in each patrone or patrone case preferably ranges from 5 to 15 g.

The patrone for use in the present invention may be one capable of feeding a film out by rotating a spool. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. Nos. 4,834,306 and 5,226,613. The photographic film for use in the present invention may be a generally so termed raw stock having not yet been developed or a developed photographic film. The raw stock and the developed photographic film may be accommodated in the same new patrone or in different patrones.

EXAMPLES

Examples of the present invention will be set forth below, however the present invention is not limited to the examples.

Gelatin-1 to gelatin-5 used as dispersion media in emulsion preparations described below have the following attributes.

Gelatin-1: Common alkali-processed ossein gelatin made from beef bones. No —$NH_2$ groups in the gelatin were chemically modified.

Gelatin-2: Gelatin formed by adding phthalic anhydride to an aqueous solution of gelatin-1 at 50° C. and pH 9.0 to cause chemical reaction, removing the residual phthalic acid, and drying the resultant material. The ratio of the number of chemically modified —$NH_2$ groups in the gelatin was 95%.

Gelatin-3: Gelatin formed by adding trimellitic anhydride to an aqueous solution of gelatin-1 at 50° C. and pH 9.0 to cause chemical reaction, removing the residual trimellitic acid, and drying the resultant material. The ratio of the number of chemically modified —$NH_2$ groups in the gelatin was 95%.

Gelatin-4: Gelatin formed by decreasing the molecular weight of gelatin-1 by allowing enzyme to act on it such that the average molecular weight was 15,000, deactivating the enzyme, and drying the resultant material. No —$NH_2$ groups in the gelatin were chemically modified.

Gelatin-5: Gelatin formed by allowing hydrogen peroxide water to act on gelatin-4 to oxidize a methionine moiety. The methionine content was 3.4 $\mu$mol/g. The molecular weight was 15,000, the same as gelatin-4. No —$NH_2$ groups in the gelatin were chemically modified.

All of gelatin-1 to gelatin-5 described above were deionized and so adjusted that the pH of an aqueous 5% solution at 35° C. was 6.0.

Example 1

This example set forth the preparation, coating, and evaluations of emulsions containing tabular grains whose thickness and distribution of silver iodide content are varied.

(Preparation of Emulsion 1-A)

[Nucleation]

1,300 mL of an aqueous solution containing 1.0 g of KBr and 1.1 g of gelatin-4 described above was stirred at 35° C. (1st solution preparation). 18 mL of an aqueous solution Ag-1 (containing 4.9 g of $AgNO_3$ in 100 mL), 13.8 mL of an aqueous solution X-1 (containing 5.2 g of KBr in 100 mL), and 4 mL of an aqueous solution G-1 (containing 8.0 g of gelatin-4 described above in 100 mL) were added over 30 sec at fixed flow rates by the triple jet method (addition 1). After that, 6.5 g of KBr were added, and the temperature was raised to 75° C. After a ripening step was performed for 12 min, 300 mL of an aqueous solution G-2 (containing 12.7 g of gelatin-3 described above in 100 mL) were added. 2.1 g of 4,5-dihydroxy-1,3-disodium disulfonate-monohydrate and 0.002 g of thiourea dioxide were sequentially added at an interval of 1 min.

<First Grain Growth>

Next, 157 mL of an aqueous solution Ag-2 (containing 22.1 g of $AgNO_3$ in 100 mL) and an aqueous solution X-2 (containing 15.5 g of KBr in 100 mL) were added over 14 min by the double jet method. The flow rate of the aqueous solution Ag-2 during the addition was accelerated such that the final flow rate was 3.4 times the initial flow rate. Also, the aqueous solution X-2 was so added that the pAg of the bulk emulsion solution in the reaction vessel was held at 8.30 (addition 2). Subsequently, 329 mL of an aqueous solution Ag-3 (containing 32.0 g of $AgNO_3$ in 100 mL) and an aqueous solution X-3 (containing 21.5 g of KBr and 1.2 g of KI in 100 mL) were added over 27 min by the double jet method. The flow rate of the aqueous solution Ag-3 during the addition was accelerated such that the final flow rate was 1.6 times the initial flow rate. Also, the aqueous solution X-3 was so added that the pAg of the bulk emulsion solution in the reaction vessel was held at 8.30 (addition 3). Furthermore, 156 mL of an aqueous solution Ag-4 (containing 32.0 g of $AgNO_3$ in 100 mL) and an aqueous solution X-4 (containing 22.4 g of KBr in 100 mL) were added over 17 min by the double jet method. The addition of the aqueous solution Ag-4 was performed at a fixed flow rate. The addition of the aqueous solution X-4 was so performed that the pAg of the bulk emulsion solution in the reaction vessel was held at 8.15 (addition 4).

<Formation of Silver Iodide Layer>

After that, 0.0025 g of sodium benzenethiosulfonate and 125 mL of an aqueous solution G-3 (containing 12.0 g of gelatin-1 described above in 100 mL) were sequentially added at an interval of 1 min. 43.7 g of KBr were then added to adjust the pAg of the bulk emulsion solution in the reaction vessel to 9.00. An aqueous solution Ag-5 (containing 11.4 g of $AgNO_3$ in 100 mL) and an aqueous solution X-5 (containing 11.1 g of KI in 100 mL) were added over 4 min by the double jet method.

<Second Grain Formation>

Two minutes after that, 249 mL of the aqueous solution Ag-4 and the aqueous solution X-4 were added by the double jet method. The addition of the aqueous solution Ag-4 was performed at a fixed flow rate over 9 min. The addition of the aqueous solution X-4 was performed only for the first 3.3 min such that the pAg of the bulk emulsion solution in the reaction vessel was held at 9.00. For the remaining 5.7 min the aqueous solution X-4 was not added so that the pAg of the bulk emulsion solution in the reaction vessel was finally 8.4 (addition 5). After that, desalting was performed by normal flocculation. Water, NaOH, and gelatin-1 described above were added under stirring, and the pH and the pAg were adjusted to 6.4 and 8.6, respectively, at 56° C.

(Preparation of Emulsion 1-B)

In this preparation of Emulsion 1-B, the low-molecular weight gelatin having the molecular weight of 15,000, used in the preparation of Emulsion 1-A, was replaced by a low-molecular weight oxidized gelatin. (The low-molecular weight oxidized gelatin was prepared by adding a hydrogen peroxide solution to an oxidized gelatin to cause chemical reaction, and then deactivating remaining hydrogen peroxide by catalase.) In this preparation of Emulsion 1-B, the ripening time at 75° C. was adjusted such that grains of the emulsion have the same grain size as that of Emulsion 1-A. An emulsion prepared as described above is Emulsion 1-B.

(Preparation of Emulsion 1-C)

In this preparation of Emulsion 1-C, the low-molecular weight gelatin having the molecular weight of 15,000, used in the preparation of Emulsion 1-A, was replaced by a low-molecular weight oxidized gelatin. (The low-molecular weight oxidized gelatin was prepared by adding a hydrogen peroxide solution to an oxidized gelatin to cause chemical reaction, and then deactivating remaining hydrogen peroxide by catalase.) In this preparation of Emulsion 1-C, the ripening time at 75° C. was adjusted such that grains of the emulsion have the same grain size as that of Emulsion 1-A. Further, the first grain growth part of the preparation of Emulsion 1-A in which grain formation is performed by the double jet method was changed to a method of performing grain formation by adding fine grains which were formed by mixing a silver nitrate solution and a halogen solution by using the agitator described in JP-A-10-43570. In this method, a proper amount of low-molecular-weight oxidized gelatin was added to the halogen solution.

(Preparation of Emulsions 1-D, 1-E and 1-F)

In the part of silver iodide layer formation in the preparation of Emulsion 1-C, silver iodide fine grains were formed by putting the Ag-5 and X-5 through the agitator described in JP-A-10-43570, and a silver iodide layer was formed by adding the fine grains. Simultaneously, Ag-4 and X-4 were added in amounts of the same mol as that of Ag-5.

Emulsions 1-D to 1-F were prepared by changing the silver iodide amount to be added in the part.

(Preparation of Emulsion 1-G)

In the part of silver iodide layer formation in the preparation of Emulsion 1-B, silver iodide fine grains were formed by putting the Ag-5 and X-5 through the agitator described in JP-A-10-43570, and a silver iodide layer was formed by adding the fine grains.

Table 1 shows the characteristic values of the emulsion grains obtained. Thereafter, the following sensitizing dyes 1, 2 and 3, potassium thiocyanate, chloroauric acid, sodium thiosulfate, and N,N-dimethylselenourea were successively added to perform optimum chemical sensitization, and then the chemical sensitization was completed by adding the following water-soluble mercapto compounds 1 and 2.

The sensitizing dye in the present invention was used as a fine solid dispersion formed by the method described in JP-A-11-52507.

For example, a fine solid dispersion of the sensitizing dye 1 was formed as follows.

A fine solid dispersion of the sensitizing dye 1 was obtained by dissolving 0.8 parts by mass of $NaNO_3$ and 3.2 parts by mass of $Na_2SO_4$ in 43 parts by mass of ion-exchanged water, adding 13 parts by mass of the sensitizing dye and dispersing the material at 60° C. for 20 min by using a dissolver blade at 2,000 rpm.

Sensitizing dye 1

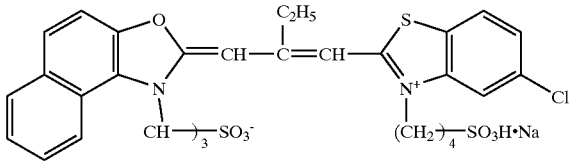

Sensitizing dye 2

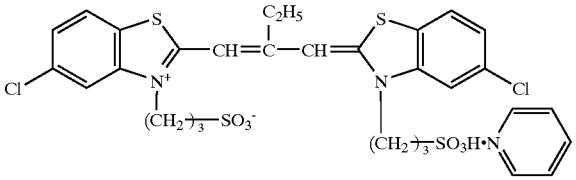

-continued

Sensitizing dye 3

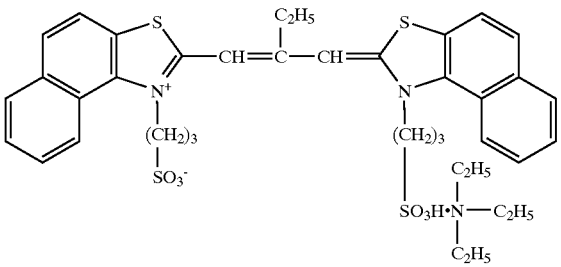

Compound 1

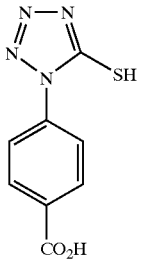

Compound 2

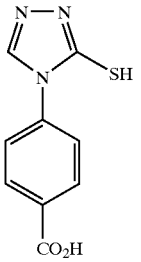

The characteristic values of the thus obtained emulsion grains are set forth in Table 1 below.

A cellulose triacetate film support having an undercoat layer was coated with the Emulsions 1-A to 1-G under the coating conditions as shown in Table 2, thereby forming samples 101 to 107, respectively.

TABLE 2

Emulsion Coating Conditions (1) Emulsion layers

| | |
|---|---|
| Emulsion . . . various emulsions | (Silver $2.1 \times 10^{-2}$ mol/m$^2$) |
| Coupler | ($1.5 \times 10^{-3}$ mol/m$^2$) |
| | ($1.1 \times 10^{-3}$ mol/m$^2$) |

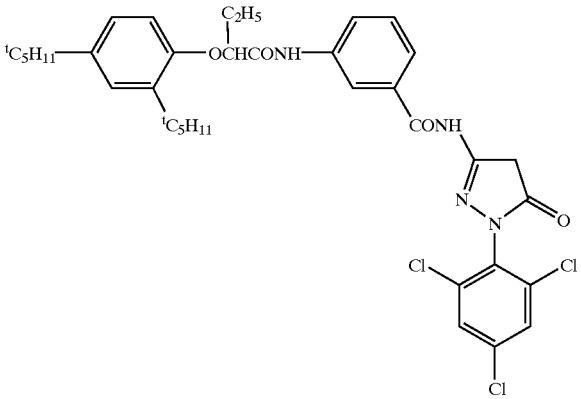

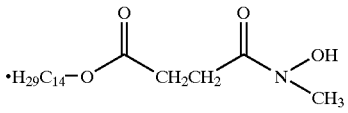

| | |
|---|---|
| Tricresyl phosphate | (1.10 g/m$^2$) |
| Gelatin | (2.30 g/m$^2$) |

TABLE 1

| Emulsion name | Equivalent-sphere diameter/ μm | Equivalent-circle diameter/ μm | Average thickness of all grains/ μm | Ratio occupied by grains having thickness less than 0.1 μm | Silver iodide content in region A | Silver iodide content in region B | Ratio occupied by grains meeting requirements (i) to (iii): (i) thickness is less than 0.1 μm; (ii) equivalent-circle diameter is 1.0 μm or more; (iii) silver iodide content in region A is higher than that in region B | Remarks |
|---|---|---|---|---|---|---|---|---|
| 1-A | 0.8 | 1.51 | 0.15 | 0% | 8 | 8 | 0% | Comparative example |
| 1-B | 0.8 | 1.69 | 0.12 | 5% | 8 | 8 | 3% | Comparative example |
| 1-C | 0.8 | 2.06 | 0.08 | 90% | 8 | 8 | 5% | Comparative example |
| 1-D | 0.8 | 2.06 | 0.08 | 90% | 8 | 3 | 80% | Present invention |
| 1-E | 0.8 | 2.06 | 0.08 | 90% | 11 | 4 | 83% | Present invention |
| 1-F | 0.8 | 2.06 | 0.08 | 90% | 5 | 2 | 73% | Present invention |
| 1-G | 0.8 | 1.69 | 0.12 | 5% | 8 | 3 | 80% | Present invention |

TABLE 2-continued

| Emulsion Coating Conditions | |
|---|---|
| (2) Protective layer | |
| 2,4-dichloro-6-hydroxy-s-triazine sodium salt | (0.08 g/m$^2$) |
| Gelatin | (1.80 g/m$^2$) |

These samples were subjected to a film hardening process at 40° C. and a relative humidity of 70% for 14 hr. The resultant samples were exposed for 1/100 sec through the SC-50 gelatin filter, a long wavelength light-transmitting filter having a cut off wave length of 500 nm, manufactured by Fuji Photo Film Co., Ltd. and a continuous wedge. The density of each sample developed as will be described later was measured through a green filter to evaluate the photographic properties.

By using the FP-350 negative processor manufactured by Fuji Photo Film Co., Ltd., the resultant samples were processed by the following method (until the accumulated replenisher amount of each solution was three times the mother solution tank volume).

(Processing Method)

| Step | Time | Temperature | Replenishment rate* |
|---|---|---|---|
| Color development | 2 min. 45 sec. | 38° C. | 45 mL |
| Bleaching | 1 min. 00 sec. | 38° C. | 20 mL bleaching solution overflow was entirely supplied into bleach-fix tank |
| Bleach-fix | 3 min. 15 sec. | 38° C. | 30 mL |
| Washing (1) | 40 sec. | 35° C. | counter flow piping from (2) to (1) |
| Washing (2) | 1 min. 00 sec. | 35° C. | 30 mL |
| Stabilization | 40 sec. | 38° C. | 20 mL |
| Drying | 1 min. 15 sec. | 55° C. | |

* The replenishment rate is represented by a value per 1.1 m of a 35-mm wide sample (equivalent to one role of 24 Ex. film).

The compositions of the processing solutions are presented below.

| (Color developer) | Tank solution (g) | Replenisher (g) |
|---|---|---|
| Diethylenetriamine pentaacetic acid | 1.0 | 1.1 |
| 1-hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-(β-hydroxy ethyl)amino]-2-methyl aniline sulfate | 4.5 | 5.5 |
| Water to make | 1.0 L | 1.0 L |
| pH (adjusted by potassium hydroxide and sulfuric acid) | 10.05 | 10.10 |

-continued

| (Bleaching solution) | common to tank solution and replenisher (g) |
|---|---|
| Ferric ammonium ethylenediamine tetraacetate dihydrate | 120.0 |
| Disodium ethylenediamine tetraacetate | 10.0 |
| Ammonium bromide | 100.0 |
| Ammonium nitrate | 10.0 |
| Bleaching accelerator $(CH_3)_2N—CH_2—CH_2—S—S—CH_2—CH_2—N(CH_3)_2 \cdot 2HCl$ | 0.005 mol |
| Ammonia water (27%) | 15.0 mL |
| Water to make | 1.0 L |
| pH (adjusted by ammonia water and nitric acid) | 6.3 |

| (Bleach-fix bath) | Tank solution (g) | Replenisher (g) |
|---|---|---|
| Ferric ammonium ethylene diaminetetraacetate dihydrate | 50.0 | — |
| Disodium ethylenediamine tetraacetate | 5.0 | 2.0 |
| Sodium sulfite | 12.0 | 20.0 |
| Aqueous ammonium thiosulfate solution (700 g/L) | 240.0 mL | 400.0 mL |
| Ammonia water (27%) | 6.0 mL | — |
| Water to make | 1.0 L | 1.0 L |
| pH (adjusted by ammonia water and acetic acid) | 7.2 | 7.3 |

(Washing water) common to tank solution and replenisher

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 0.15 g/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| Disodium ethylenediaminetetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

The results are shown in Table 3 below. The sensitivity is indicated by the relative value of the reciprocal of an exposure amount required to reach a density of fog density plus 0.2. (The sensitivity of sample 101 was regarded as 100.)

With respect to the dependence on processing, color development of each sample was performed for 1'15" (1 min 15 sec) and 3'45" (3 min 45 sec), and the difference in the fog density between the sample developed for 1'15" and the sample for 3'45" was determined as its dependence on processing. The dependence on processings of the samples were relatively shown with the dependence on processing of sample 101 regarded as 100. The less value the dependence on processing of a sample has, the smaller the dependence on processing is and preferable.

TABLE 3

| Sample name | Emulsion name | Sensitivity | Dependence on processing | |
|---|---|---|---|---|
| 101 | 1-A | 100 | 100 | Comparative example |
| 102 | 1-B | 105 | 130 | Comparative example |
| 103 | 1-C | 163 | 180 | Comparative example |
| 104 | 1-D | 195 | 90 | Present invention |
| 105 | 1-E | 205 | 85 | Present invention |
| 106 | 1-F | 175 | 96 | Present invention |
| 107 | 1-G | 173 | 90 | Present invention |

Table 3 shows that decreasing the grain thickness to be less than 0.1 μm greatly deteriorates the dependence on processing of a sample, though it increases the sensitivity of the sample.

However, the dependence on processing of a sample is greatly improved by using an emulsion having the silver iodide structure of the present invention. Therefore, it was found that using an emulsion of the present invention increased the sensitivity of a photographic material, while the dependence on processing obtained by using emulsion grains having a large grain thickness was maintained or rather improved. The present invention produced remarkable effects.

Table 3 shows that, of emulsions of the present invention, an emulsion whose silver iodide content in region A was 7 mol % or more had a higher sensitivity and more excellent dependence on processing.

Example 2

1) Support

The support used in this example was prepared by the following method.

1) First layer and substratum:

Both surfaces of a 90 μm thick polyethylene naphthalate support were treated with glow discharge under such conditions that the treating ambient pressure was 2.66×10 Pa, the $H_2O$ partial pressure of ambient gas 75%, the discharge frequency 30 kHz, the output 2,500 W, and the treating strength 0.5 kV.A.min/$m^2$. This support was coated, in a coating amount of 5 mL/$m^2$, with a coating liquid of the following composition to provide the 1st layer in accordance with the bar coating method described in JP-B-58-4589.

| | |
|---|---|
| Conductive fine grain dispersion ($SnO_2/Sb_2O_5$ grain conc. 10% water dispersion, secondary agglomerate of 0.005 μm grain size primary grains which has an av. grain size of 0.05 μm) | 50 pts.wt. |
| Gelatin | 0.5 pt.wt. |
| Water | 49 pts.wt. |
| Polyglycerol polyglycidyl ether | 0.16 pt.wt. |
| Polyoxyethylene sorbitan monolaurate (polymn. degree 20) | 0.1 pt.wt. |

Additionally, the support furnished with the first coating layer was wound round a stainless steel core of 20 cm diameter, heated at 110° C. (Tg of PEN support: 119° C.) for 48 hr to thereby effect thermal hysteresis, and subjected to annealing treatment. The other side of the support opposite to the first layer was coated, in a coating amount of 10 mL/$m^2$, with a coating liquid of the following composition to provide a substratum for emulsion in accordance with the bar coating method.

| | |
|---|---|
| Gelatin | 1.01 pts.wt. |
| Salicylic acid | 0.30 pt.wt. |
| Resorcin | 0.40 pt.wt. |
| Polyoxyethylene nonylphenyl ether (polymn. degree 10) | 0.11 pt.wt. |
| Water | 3.53 pt.wt. |
| Methanol | 84.57 pts.wt. |
| n-Propanol | 10.08 pts.wt. |

Furthermore, the following second layer and third layer were superimposed in this sequence on the first layer by coating. Finally, multilayer coating of a color negative photosensitive material of the composition indicated below was performed on the opposite side. Thus, a transparent magnetic recording medium with silver halide emulsion layers was obtained.

2) Second layer (transparent magnetic recording layer):

(1) Dispersion of magnetic substance:

1100 parts by mass of Co-coated γ-$Fe_2O_3$ magnetic substance (average major axis length: 0.25 μm, $S_{BET}$: 39 $m^2$/g, Hc: 6.56×$10^4$ A/m, as: 77.1 $Am^2$/kg, and σ r: 37.4 $Am^2$/kg), 220 parts by mass of water and 165 parts by mass of silane coupling agent (3-(polyoxyethynyl)oxypropyl trimethoxysilane (polymerization degree: 10)) were fed into an open kneader, and blended well for 3 hr. The resultant coarsely dispersed viscous liquid was dried at 70° C. round the clock to thereby remove water, and heated at 110° C. for 1 hr. Thus, surface treated magnetic grains were obtained.

Further, in accordance with the following recipe, a composition was prepared by blending by means of the open kneader once more for 4 hr. Thus, blend liquid was obtained.

| | |
|---|---|
| The above surface treated magnetic grains | 855 g |
| Diacetylcellulose | 25.3 g |
| Methyl ethyl ketone | 136.3 g |
| Cyclohexanone | 136.3 g |

Still further, in accordance with the following recipe, a composition was prepared by carrying out fine dispersion by means of a sand mill (1/4G sand mill) at 2000 rpm for 4 hr. Glass beads of 1 mmϕ diameter were used as medium. Thus, fine dispersion of magnetic substance was obtained.

| | |
|---|---|
| The above blend liquid | 45 g |
| Diacetylcellulose | 23.7 g |
| Methyl ethyl ketone | 127.7 g |
| Cyclohexanone | 127.7 g |

Moreover, in accordance with the following recipe, a magnetic substance-containing intermediate liquid was prepared.

(2) Preparation of magnetic substance-containing intermediate liquid:

| | |
|---|---|
| The above fine dispersion of magnetic substance | 674 g |
| Diacetylcellulose soln. (solid content 4.34%, solvent: methyl ethyl ketone/cyclohexanone = 1/1) | 24,280 g |
| Cyclohexanone | 46 g |

These were mixed together and agitated by means of a disperser to thereby obtain a "magnetic substance-containing intermediate liquid".

An α-alumina abrasive dispersion in the present invention was produced in accordance with the following recipe.

(a) Preparation of Sumicorundum AA-1.5 (average primary grain diameter: 1.5 μm, specific surface area: 1.3 $m^2/g$) grain dispersion

| | |
|---|---|
| Sumicorundum AA-1.5 | 152 g |
| Silane coupling agent KBM903 (produced by Shin-Etsu Silicone) | 0.48 g |
| Diacetylcellulose soln. (solid content 4.5%, solvent: methyl ethyl ketone/cyclohexanone = 1/1) | 227.52 g |

In accordance with the above recipe, fine dispersion was carried out by means of a ceramic-coated sand mill (1/4G sand mill) at 800 rpm for 4 hr. Zirconia beads of 1 mmϕ diameter were used as medium.

(b) Colloidal silica grain dispersion (fine grains)

Use was made of "MEK-ST" produced by Nissan Chemical Industries, Ltd.

This is a dispersion of colloidal silica of 0.015 μm average primary grain diameter in methyl ethyl ketone as a dispersion medium, wherein the solid content is 30%.

(3) Preparation of a coating liquid for second layer:

| | |
|---|---|
| The above magnetic substance-containing intermediate liquid | 19,053 g |
| Diacetylcellulose soln. (solid content 4.5%, solvent: methyl ethyl ketone/cyclohexanone = 1/1) | 264 g |
| Colloidal silica dispersion "MEK-ST" (dispersion b, solid content: 30%) | 128 g |
| AA-1.5 dispersion (dispersion a) | 12 g |
| Millionate MR-400 (produced ny Nippon Polyurethane) diluent (solid content 20%, diluent solvent: methyl ethyl ketone/cyclohexanone = 1/1) | 203 g |
| Methyl ethyl ketone | 170 g |
| Cyclohexanone | 170 g |

A coating liquid obtained by mixing and agitating these was applied in a coating amount of 29.3 $mL/m^2$ with the use of a wire bar. Drying was performed at 110° C. The thickness of magnetic layer after drying was 1.0 μm.

3) Third layer (higher fatty acid ester sliding agent-containing layer)

(1) Preparation of raw dispersion of sliding agent

The following liquid A was heated at 100° C. to thereby effect dissolution, added to liquid B and dispersed by means of a high-pressure homogenizer, thereby obtaining a raw dispersion of sliding agent.

Liquid A

Compd. of the formula:

$C_6H_{13}CH(OH)(CH_2)_{10}COOC_{50}H_{101}$ 399 pts.wt.

Compd. of the formula:

$n\text{-}C_{50}H_{101}O(CH_2CH_2O)_{16}H$ 171 pts.wt.

Cyclohexanone 830 pts.wt.

Liquid B

Cyclohexanone 8600 pts.wt.

(2) Preparation of spherical inorganic grain dispersion

Spherical inorganic grain dispersion (c1) was prepared in accordance with the following recipe.

| | |
|---|---|
| Isopropyl alcohol | 93.54 pts. wt. |
| Silane coupling agent KBM903 (produced by Shin-Etsu Silicone) Compd. 1-1: | 5.53 pts. wt. |

-continued

| | |
|---|---|
| $(CH_3O)_3Si—(CH_2)_3—NH_2$ Compound A | 2.93 pts. wt. |

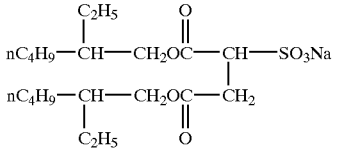

Seahostar KEP50 (amorphous spherical silica, av. grain size 0.5 μm, produced by Nippon Shokubai Ltd.) 88.00 pts.wt.

This composition was agitated for 10 min, and further the following was added.

Diacetone alcohol 252.93 pts.wt.

The resultant liquid was dispersed by means of ultrasonic homogenizer "SONIFIER 450 (manufactured by Branson)" for 3 hr while cooling with ice and stirring, thereby finishing spherical inorganic grain dispersion c1.

(3) Preparation of spherical organic polymer grain dispersion

Spherical organic polymer grain dispersion (c2) was prepared in accordance with the following recipe.

| | |
|---|---|
| XC99-A8808 (produced by Toshiba Silicone Co., Ltd., sherical crosslinked polysiloxane grain, av. grain size 0.9 μm) | 60 pts.wt. |
| Methyl ethyl ketone | 120 pts.wt. |
| Cyclohexanone | 120 pts.wt. |

(solid content 20%, solvent: methyl ethyl ketone/cyclohexanone=1/1)

This mixture was dispersed by means of ultrasonic homogenizer "SONIFIER 450 (manufactured by Branson)" for 2 hr while cooling with ice and stirring, thereby finishing spherical organic polymer grain dispersion c2.

(4) Preparation of coating liquid for 3rd layer

A coating liquid for 3rd layer was prepared by adding the following components to 542 g of the aforementioned raw dispersion of sliding agent.

| | |
|---|---|
| Diacetone alcohol | 5950 g |
| Cyclohexanone | 176 g |
| Ethyl acetate | 1700 g |
| Above Seahostar KEP50 dispersion (cl) | 53.1 g |
| Above spherical organic polymer grain dispersion (c2) | 300 g |
| FC431 (produced by 3M, solid content 50%, solvent: ethyl acetate) | 2.65 g |
| BYK310 (produced by BYK ChemiJapan, solid content 25%) | 5.3 g |

The above 3rd-layer coating liquid was applied to the 2nd layer in a coating amount of 10.35 $mL/m^2$, dried at 110° C. and further postdried at 97° C. for 3 min.

4) Application of lightsensitive layer by coating:

The thus obtained back layers on its side opposite to the support were coated with a plurality of layers of the following respective compositions, thereby obtaining a color negative film.

(Composition of lightsensitive layer)

The numeric value given beside the description of each component is for the coating amount expressed in the unit of $g/m^2$. With respect to the silver halide and colloidal silver, the coating amount is in terms of silver quantity.

1st layer (1st antihalation layer)

| | | |
|---|---|---|
| Black colloidal silver | silver | 0.122 |
| Silver iodobromide emulsion grains having an average equivalent-sphere diameter of 0.07 μm | silver | 0.01 |
| Gelatin | | 0.919 |
| ExM-1 | | 0.066 |
| ExC-1 | | 0.002 |
| ExC-3 | | 0.002 |
| Cpd-2 | | 0.001 |
| F-8 | | 0.001 |
| HBS-1 | | 0.050 |
| HBS-2 | | 0.002 |

2nd layer (2nd antihalation layer)

| | | |
|---|---|---|
| Black colloidal silver | silver | 0.055 |
| Gelatin | | 0.425 |
| ExF-1 | | 0.002 |
| F-8 | | 0.001 |
| Solid disperse dye ExF-7 | | 0.120 |
| HBS-1 | | 0.074 |

3rd layer (Interlayer)

| | | |
|---|---|---|
| ExC-2 | | 0.050 |
| Cpd-1 | | 0.090 |
| Polyethylacrylate latex | | 0.200 |
| HBS-1 | | 0.100 |
| Gelatin | | 0.700 |

4th layer (Low-speed red-sensitive emulsion layer)

| | | |
|---|---|---|
| Em-D | silver | 0.577 |
| Em-C | silver | 0.347 |
| ExC-1 | | 0.188 |
| ExC-2 | | 0.011 |
| ExC-3 | | 0.075 |
| ExC-4 | | 0.121 |
| ExC-5 | | 0.010 |
| ExC-6 | | 0.007 |
| ExC-8 | | 0.050 |
| ExC-9 | | 0.020 |
| Cpd-2 | | 0.025 |
| Cpd-4 | | 0.025 |
| UV-2 | | 0.047 |
| UV-3 | | 0.086 |
| UV-4 | | 0.018 |
| HBS-1 | | 0.245 |
| HBS-5 | | 0.038 |
| Gelatin | | 0.994 |

5th layer (Medium-speed red-sensitive emulsion layer)

| | | |
|---|---|---|
| Em-B | silver | 0.431 |
| Em-C | silver | 0.432 |
| ExC-1 | | 0.154 |
| ExC-2 | | 0.068 |
| ExC-3 | | 0.018 |
| ExC-4 | | 0.103 |
| ExC-5 | | 0.023 |
| ExC-6 | | 0.010 |
| ExC-8 | | 0.016 |
| ExC-9 | | 0.005 |
| Cpd-2 | | 0.036 |
| Cpd-4 | | 0.028 |
| HBS-1 | | 0.129 |
| Gelatin | | 0.882 |

6th layer (High-speed red-sensitive emulsion layer)

| | | |
|---|---|---|
| Em-A | silver | 1.108 |
| ExC-1 | | 0.180 |
| ExC-3 | | 0.035 |
| ExC-6 | | 0.029 |
| ExC-8 | | 0.110 |
| ExC-9 | | 0.020 |
| Cpd-2 | | 0.064 |
| Cpd-4 | | 0.077 |
| HBS-1 | | 0.329 |
| HBS-2 | | 0.120 |
| Gelatin | | 1.245 |

-continued

7th layer (Interlayer)

| | | |
|---|---|---|
| Cpd-1 | | 0.094 |
| Cpd-6 | | 0.369 |
| Solid disperse dye ExF-4 | | 0.030 |
| HBS-1 | | 0.049 |
| Polyethylacrylate latex | | 0.088 |
| Gelatin | | 0.886 |

8th layer (layer for donating interlayer effect to red-sensitive layer)

| | | |
|---|---|---|
| Em-J | silver | 0.153 |
| Em-K | silver | 0.153 |
| Cpd-4 | | 0.030 |
| ExM-2 | | 0.120 |
| ExM-3 | | 0.016 |
| ExM-4 | | 0.026 |
| ExY-1 | | 0.016 |
| ExY-4 | | 0.036 |
| ExC-7 | | 0.026 |
| HBS-1 | | 0.218 |
| HBS-3 | | 0.003 |
| HBS-5 | | 0.030 |
| Gelatin | | 0.610 |

9th layer (Low-speed green-sensitive emulsion layer)

| | | |
|---|---|---|
| Em-H | silver | 0.329 |
| Em-G | silver | 0.333 |
| Em-I | silver | 0.088 |
| ExM-2 | | 0.378 |
| ExM-3 | | 0.047 |
| ExY-1 | | 0.017 |
| ExC-7 | | 0.007 |
| HBS-1 | | 0.098 |
| HBS-3 | | 0.010 |
| HBS-4 | | 0.077 |
| HBS-5 | | 0.548 |
| Cpd-5 | | 0.010 |
| Gelatin | | 1.470 |

10th layer (Medium-speed green-sensitive emulsion layer)

| | | |
|---|---|---|
| Em-F | silver | 0.457 |
| ExM-2 | | 0.032 |
| ExM-3 | | 0.029 |
| ExY-3 | | 0.007 |
| ExC-6 | | 0.010 |
| ExC-7 | | 0.012 |
| ExC-8 | | 0.010 |
| HBS-1 | | 0.065 |
| HBS-3 | | 0.002 |
| HBS-4 | | 0.020 |
| HBS-5 | | 0.020 |
| Cpd-5 | | 0.004 |
| Gelatin | | 0.446 |

11th layer (High-speed green-sensitive emulsion layer)

| | | |
|---|---|---|
| Em-E | silver | 0.794 |
| ExC-6 | | 0.002 |
| ExC-8 | | 0.010 |
| ExM-1 | | 0.013 |
| ExM-2 | | 0.011 |
| ExM-3 | | 0.030 |
| ExY-3 | | 0.003 |
| Cpd-3 | | 0.004 |
| Cpd-4 | | 0.007 |
| Cpd-5 | | 0.010 |
| HBS-1 | | 0.148 |
| HBS-3 | | 0.003 |
| HBS-4 | | 0.020 |
| HBS-5 | | 0.037 |
| Polyethylacrylate latex | | 0.099 |
| Gelatin | | 0.939 |

12th layer (Yellow filter layer)

| | | |
|---|---|---|
| Cpd-1 | | 0.094 |
| Solid disperse dye ExF-2 | | 0.070 |
| Solid disperse dye ExF-5 | | 0.010 |
| Oil-soluble dye ExF-6 | | 0.010 |
| HBS-1 | | 0.049 |
| Gelatin | | 0.630 |

-continued

| | | |
|---|---|---|
| 13th layer (Low-speed blue-sensitive emulsion layer) | | |
| Em-O | silver | 0.112 |
| Em-M | silver | 0.320 |
| Em-N | silver | 0.240 |
| ExC-1 | | 0.027 |
| ExC-7 | | 0.013 |
| ExY-1 | | 0.002 |
| ExY-2 | | 0.890 |
| ExY-4 | | 0.058 |
| Cpd-2 | | 0.100 |
| Cpd-3 | | 0.004 |
| HBS-1 | | 0.222 |
| HBS-5 | | 0.074 |
| Gelatin | | 1.553 |
| 14th layer (High-speed blue-sensitive emulsion layer) | | |
| Em-L | silver | 0.714 |
| ExY-2 | | 0.211 |
| ExY-4 | | 0.068 |
| Cpd-2 | | 0.075 |
| Cpd-3 | | 0.001 |
| HBS-1 | | 0.124 |
| Gelatin | | 0.678 |
| 15th layer (1st protective layer) | | |
| Silver iodobromide emulsion grains having an average equivalent-sphere diameter of 0.07 μm | silver | 0.301 |
| UV-1 | | 0.211 |
| UV-2 | | 0.132 |
| UV-3 | | 0.198 |
| UV-4 | | 0.026 |
| F-11 | | 0.009 |
| S-1 | | 0.086 |
| HBS-1 | | 0.175 |
| HBS-4 | | 0.050 |
| Gelatin | | 1.984 |

-continued

| | |
|---|---|
| 16th layer (2nd protective layer) | |
| H-1 | 0.400 |
| B-1 (diameter 1.7 μm) | 0.050 |
| B-2 (diameter 1.7 μm) | 0.150 |
| B-3 | 0.050 |
| S-1 | 0.200 |
| Gelatin | 0.750 |

In addition to the above components, W-1 to W-6, B-4 to B-6, F-1 to F-17, a lead salt, a platinum salt, an iridium salt and a rhodium salt were appropriately added to the individual layers in order to improve the storability, processability, resistance to pressure, mildewproofing and antiseptic properties, antistatic properties and coating property thereof. (Preparation of Dispersion of Organic Solid Disperse Dye)

The ExF-2 of the 12th layer was dispersed by the following method.

| | |
|---|---|
| Wet cake of ExF-2 (containing 17.6 wt. % water) | 2.800 kg |
| Sodium octylphenyldiethoxymethanesulfonate (31 wt. % aq. solution) | 0.376 kg |
| F-15 (7% aq. solution) | 0.011 kg |
| Water | 4.020 kg |
| Total (adjusted to pH = 7.2 with NaOH). | 7.210 kg |

Slurry of the above composition was agitated by means of a dissolver, and further dispersed by means of agitator mill LMK-4 under such conditions that the peripheral speed, delivery rate and packing ratio of 0.3 mm-diameter zirconia beads were 10 m/s, 0.6 kg/min and 80%, respectively, until the absorbance ratio of the dispersion became 0.29. Thus, a solid particulate dispersion was obtained, wherein the average particle diameter of dye particulate was 0.29 μm.

TABLE 4

| Emulsion name | Average iodide (mol %) | Equivalent-sphere diameter (μm) | Aspect ratio | Equivalent-circle diameter (μm) | Grain thickness (μm) | Shape |
|---|---|---|---|---|---|---|
| Em-A | 4 | 0.92 | 14 | 2 | 0.14 | Tabular |
| Em-B | 5 | 0.8 | 12 | 1.6 | 0.13 | Tabular |
| Em-C | 4.7 | 0.51 | 7 | 0.85 | 0.12 | Tabular |
| Em-D | 3.9 | 0.37 | 2.7 | 0.4 | 0.15 | Tabular |
| Em-E | 5 | 0.92 | 14 | 2 | 0.14 | Tabular |
| Em-F | 5.5 | 0.8 | 12 | 1.6 | 0.13 | Tabular |
| Em-G | 4.7 | 0.51 | 7 | 0.85 | 0.12 | Tabular |
| Em-H | 3.7 | 0.49 | 3.2 | 0.58 | 0.18 | Tabular |
| Em-I | 2.8 | 0.29 | 1.2 | 0.27 | 0.23 | Tabular |
| Em-J | 5 | 0.8 | 12 | 1.6 | 0.13 | Tabular |
| Em-K | 3.7 | 0.47 | 3 | 0.53 | 0.18 | Tabular |
| Em-L | 5.5 | 1.4 | 9.8 | 2.6 | 0.27 | Tabular |
| Em-M | 8.8 | 0.64 | 5.2 | 0.85 | 0.16 | Tabular |
| Em-N | 3.7 | 0.37 | 4.6 | 0.55 | 0.12 | Tabular |
| Em-O | 1.8 | 0.19 | — | — | — | Cubic |

In Table 4, emulsions Em-A to -C contained the optimum amount of spectral sensitizing dyes 1 to 3, and were subjected to gold sensitization, sulfur sensitization and selenium sensitization optimally. Emulsions Em-E to -G contained the optimum amount of spectral sensitizing dyes 4 to 6, and were subjected to gold sensitization, sulfur sensitization and selenium sensitization optimally. Emulsion Em-J contained the optimum amount of spectral sensitizing dyes 7 and 8, and was subjected to gold sensitization, sulfur sensitization and selenium sensitization optimally. Emulsion Em-L contained the optimum amount of spectral sensitizing dyes 9 to 11, and was subjected to gold sensitization, sulfur sensitization and selenium sensitization optimally. Emulsion Em-O contained the optimum amount of spectral sensitizing dyes 10 to 12, and was subjected to gold sensitization and sulfur sensitization optimally. Emulsions Em-D, -H, -I, -K, -M and -N contained the optimum amount of spectral sensitizing dyes listed in Table 5, and were subjected to gold sensitization, sulfur sensitization and selenium sensitization optimally. All of Emulsions Em-A to -O contained silver iodobromide and did not contain silver chloride.

TABLE 5

| Emulsion name | Sensitizing dye | Addition amount (mol/mol of silver) |
|---|---|---|
| Em-D | Sensitizing dye 1 | $5.44 \times 10^{-4}$ |
| | Sensitizing dye 2 | $2.35 \times 10^{-4}$ |
| | Sensitizing dye 3 | $7.26 \times 10^{-6}$ |
| Em-H | Sensitizing dye 8 | $6.52 \times 10^{-4}$ |
| | Sensitizing dye 13 | $1.35 \times 10^{-4}$ |
| | Sensitizing dye 6 | $2.48 \times 10^{-5}$ |
| Em-I | Sensitizing dye 8 | $6.09 \times 10^{-4}$ |
| | Sensitizing dye 13 | $1.26 \times 10^{-4}$ |
| | Sensitizing dye 6 | $2.32 \times 10^{-5}$ |
| Em-K | Sensitizing dye 7 | $6.27 \times 10^{-4}$ |
| | Sensitizing dye 8 | $2.24 \times 10^{-4}$ |
| Em-M | Sensitizing dye 9 | $2.43 \times 10^{-4}$ |
| | Sensitizing dye 10 | $2.43 \times 10^{-4}$ |
| | Sensitizing dye 11 | $2.43 \times 10^{-4}$ |
| Em-N | Sensitizing dye 9 | $3.28 \times 10^{-4}$ |
| | Sensitizing dye 10 | $3.28 \times 10^{-4}$ |
| | Sensitizing dye 11 | $3.28 \times 10^{-4}$ |

The sensitizing dyes used in the examples of the present invention will be listed below.

Sensitizing dye 1

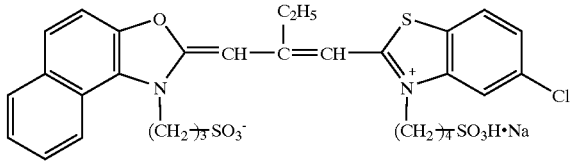

Sensitizing dye 2

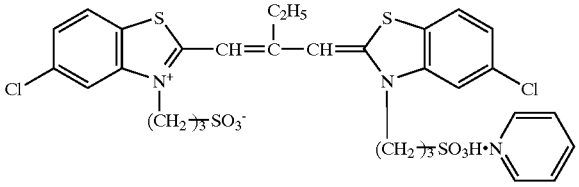

Sensitizing dye 3

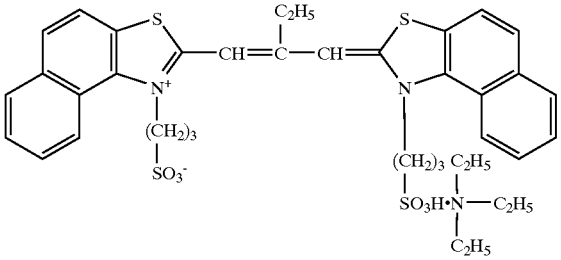

-continued

Sensitizing dye 4

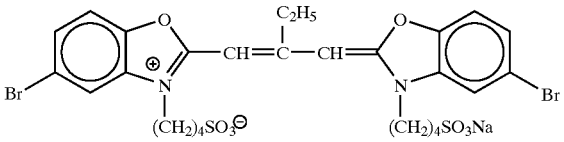

Sensitizing dye 5

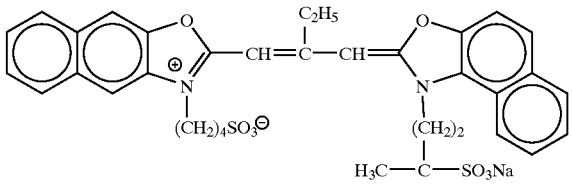

Sensitizing dye 6

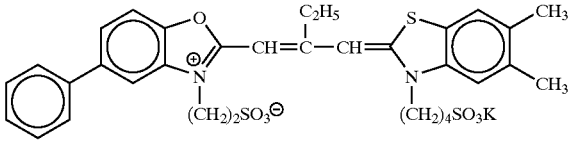

Sensitizing dye 7

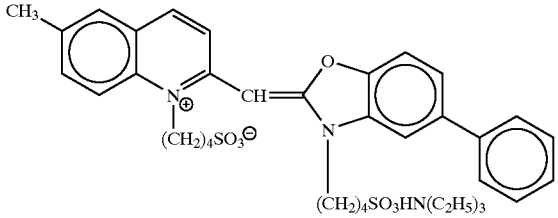

Sensitizing dye 8

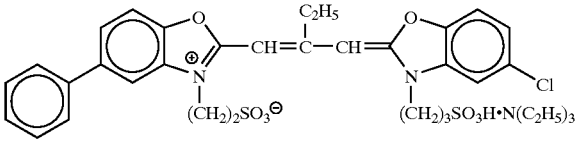

Sensitizing dye 9

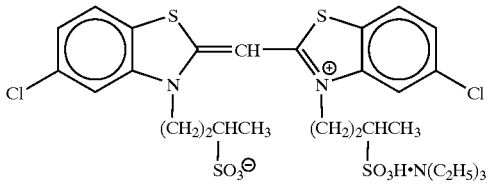

Sensitizing dye 10

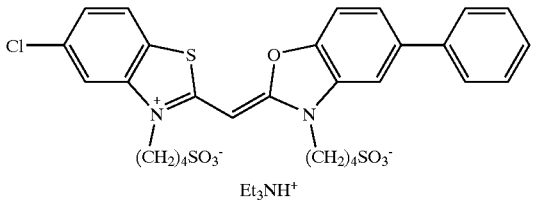

Sensitizing dye 11

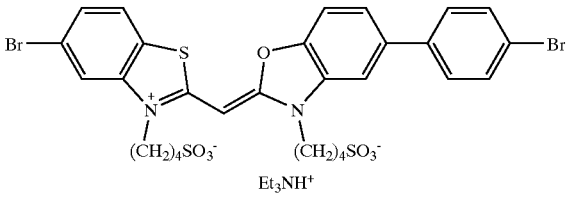

-continued

Sensitizing dye 12

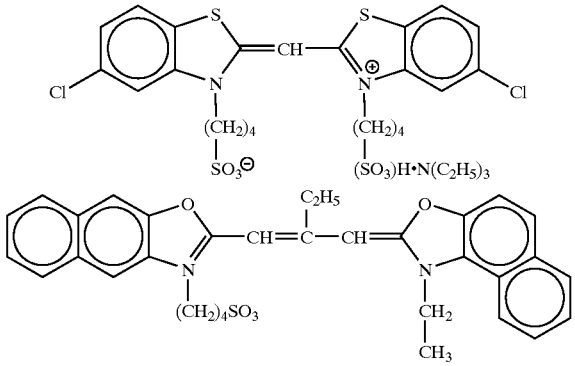

For the preparation of the tabular grains, a low-molecular-weight gelatin was used according to the examples described in JP-A-1-158426.

Emulsions Em-A to -K contained the optimum amount of Ir and Fe.

Emulsions Em-L to -O were reduction-sensitized at the time of preparing the grains.

If a high-voltage electron microscope is used, it is observed that the tabular grains have dislocation lines as described in the publication of JP-A-3-237450.

With respect to Emulsions Em-A to -C and -J, dislocation introduction was performed by using the iodide ion-releasing agent according to the examples described in the publication of JP-A-6-11782.

With respect to Emulsion Em-E, dislocation introduction was performed by using the silver iodide fine grains prepared immediately before being added. The preparation was conducted in a different chamber having a magnetic coupling induction type mixer described in the publication of JP-A-10-43570.

The other compounds used in the emulsion layers will be listed below.

ExC-1

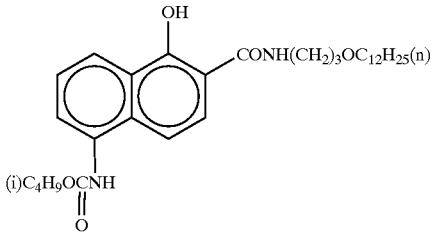

ExC-2

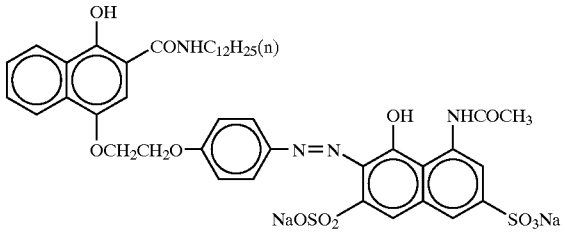

ExC-3

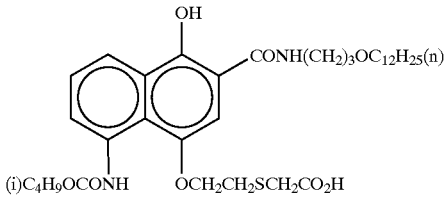

ExC-4

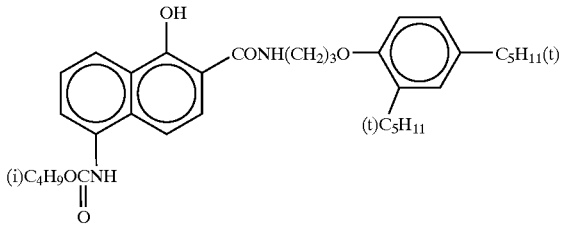

ExC-5

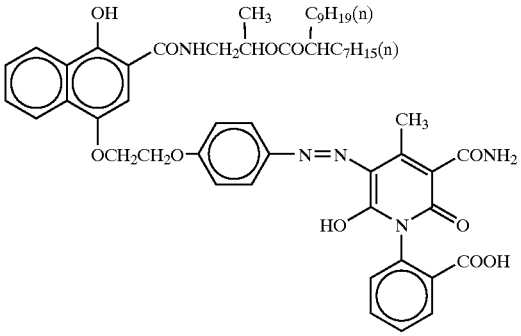

ExC-6

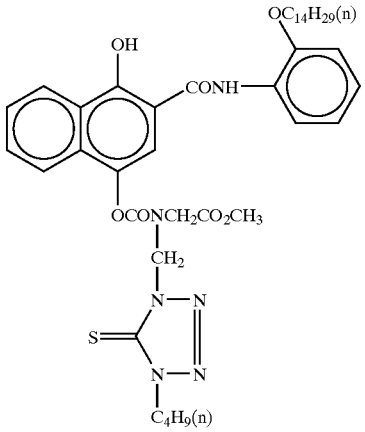

-continued
ExC-7
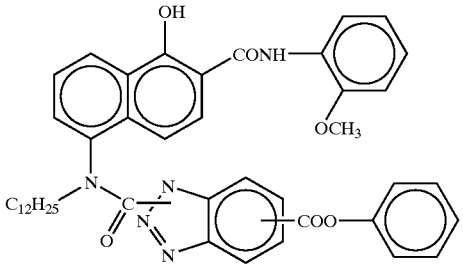
ExC-8
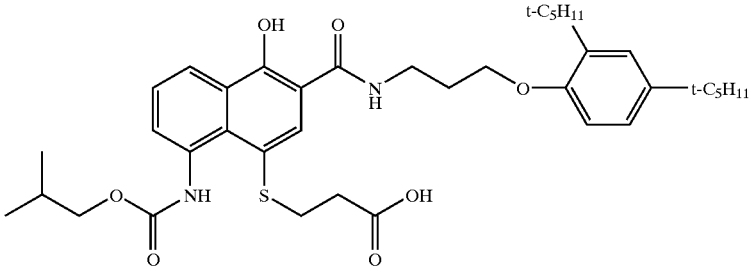
ExC-9
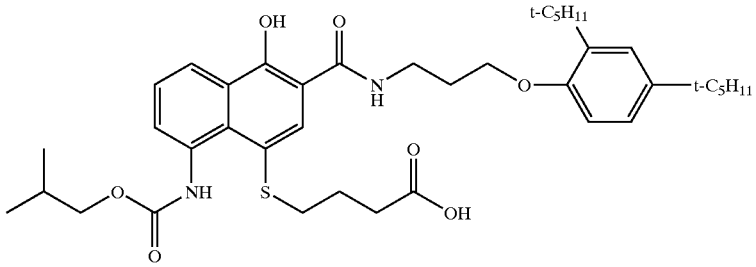
ExM-1
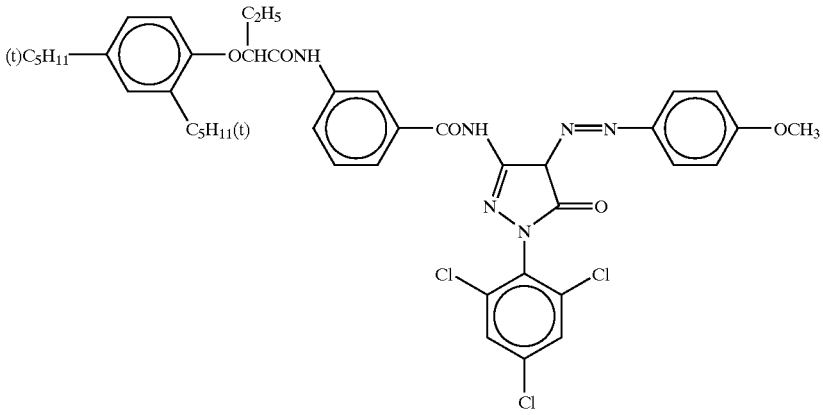
ExM-2
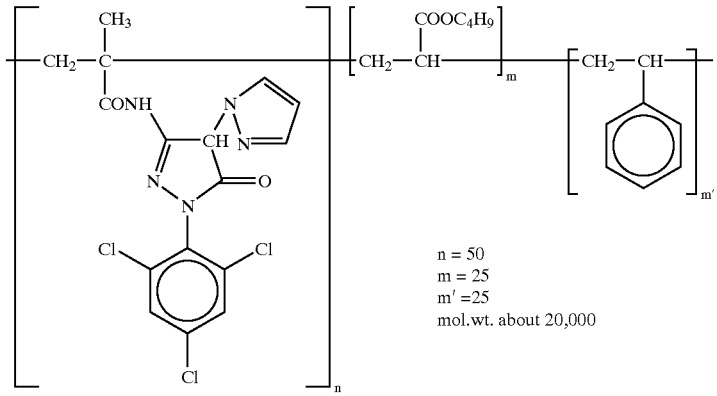

-continued
ExM-3
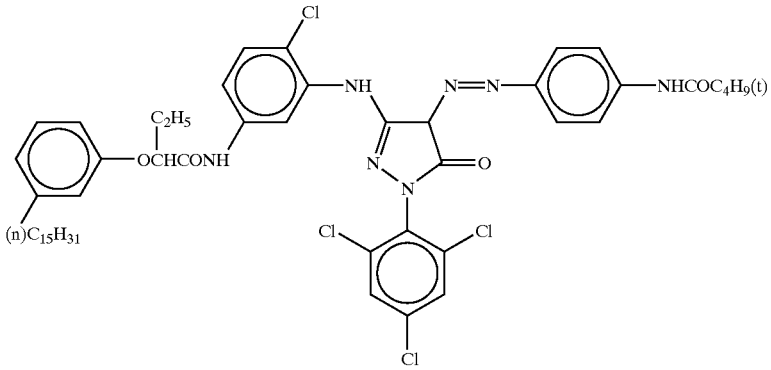
ExM-4
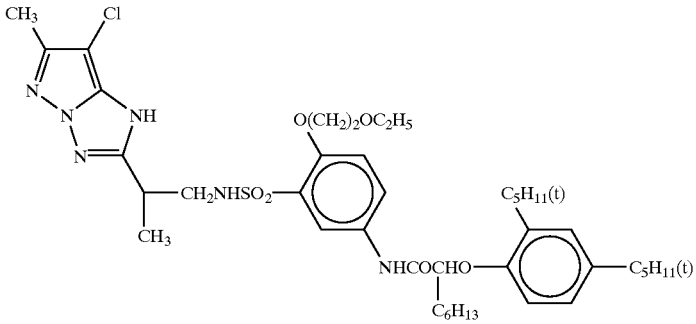
ExY-1
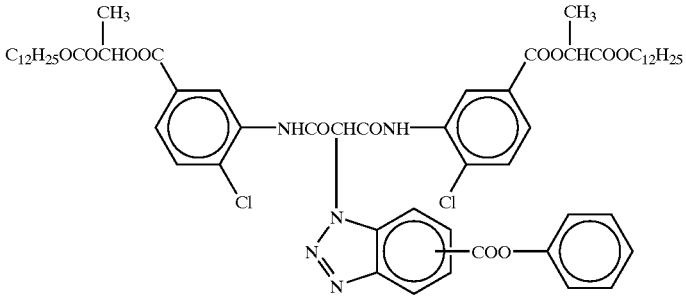
ExY-2
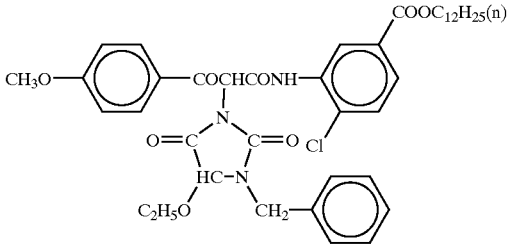
ExY-3
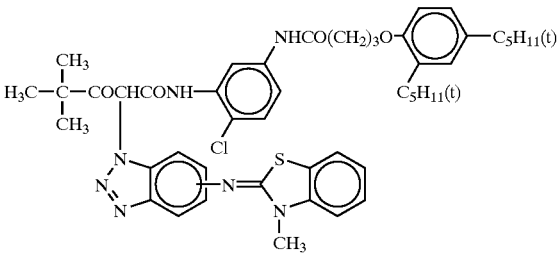
ExY-4
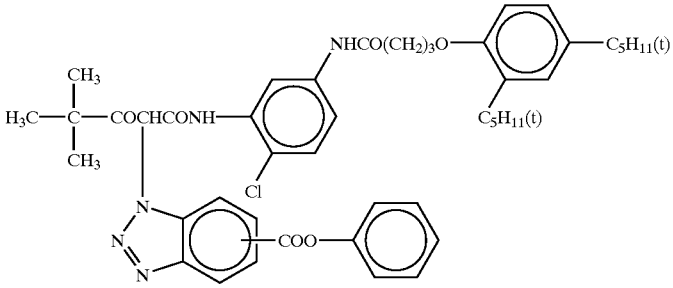

-continued
Cpd-1
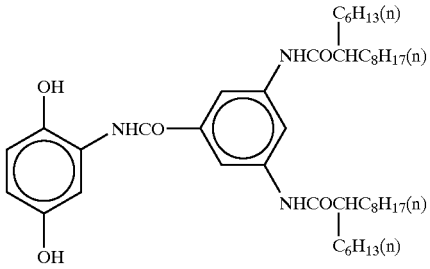
Cpd-2
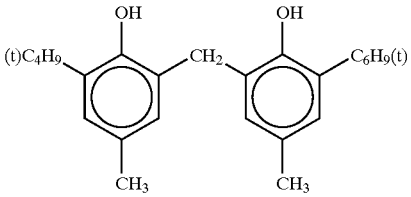
Cpd-3
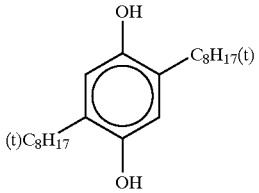
Cpd-4
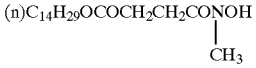
Cpd-5
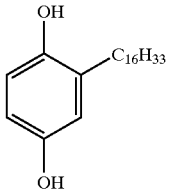
Cpd-6
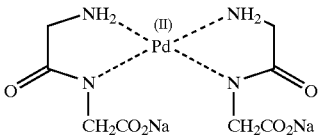
UV-1
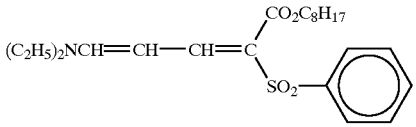
UV-2
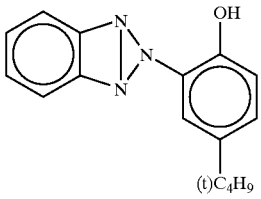
UV-3
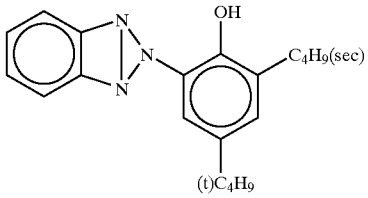
UV-4
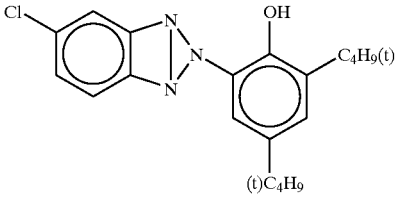
B-1
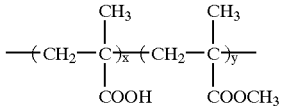
x/y = 10/90 (mass ratio)
Average molecular weight: about 35,000
B-2
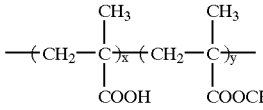
x/y = 40/60 (mass ratio)
Average molecular weight: about 20,000
B-3
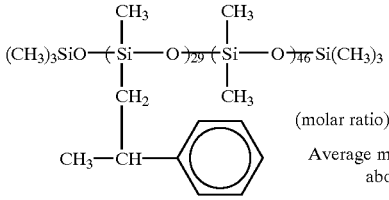
(molar ratio)
Average molecular weight: about 8,000
H-1
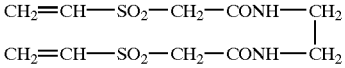
HBS-1
Tricresyl phosphate
HBS-2
Di-n-butyl phthalate
HBS-3
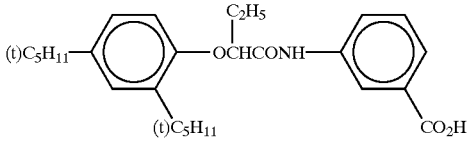
HBS-4
Tri(2-ethylhexyl)phosphate -continued
HBS-5
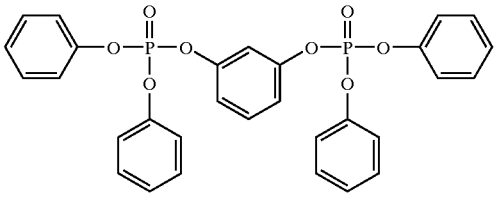
S-1
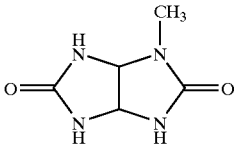
F-1
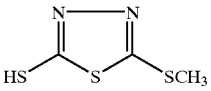
F-2
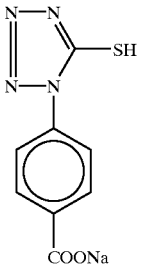
F-3
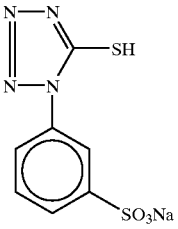
F-4
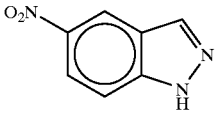
F-5
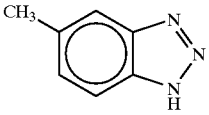
F-6
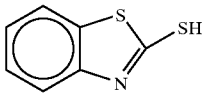
F-7
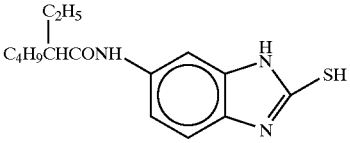
F-8
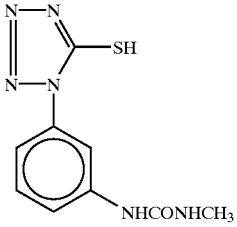
F-9
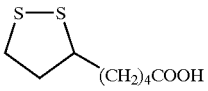
F-10
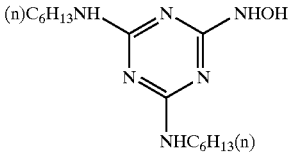
F-11
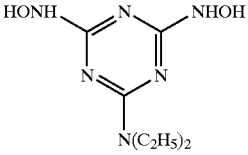
F-12
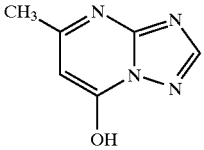
F-13
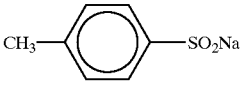
F-14
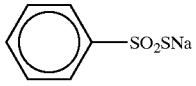

-continued
F-15
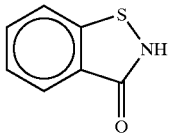
F-16
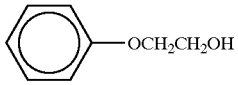
F-17
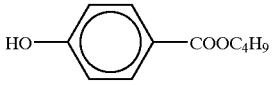
W-1
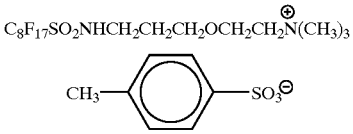
W-2
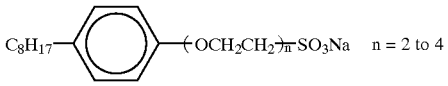
n = 2 to 4
W-3
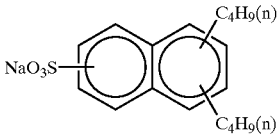
W-4
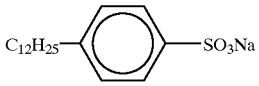
W-5
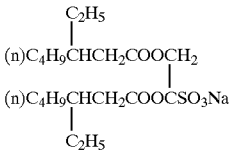
W-6
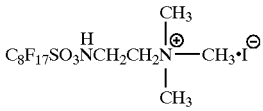
B-4
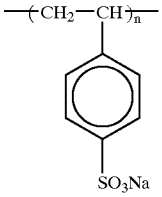
Average molecular ratio: about 750,000
B-5
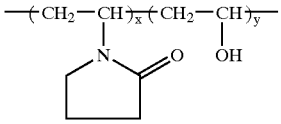
x/y = 70/30 (weight ratio)
Average molecular ratio: about 17,000
B-6
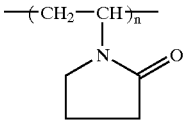
Average molecular ratio: about 10,000
ExF-1
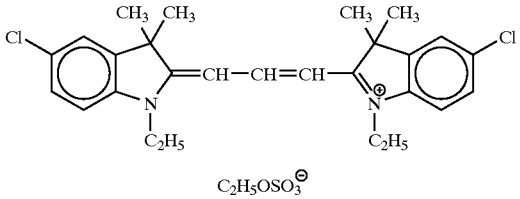
ExF-2
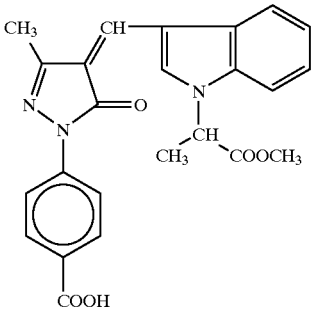
ExF-4
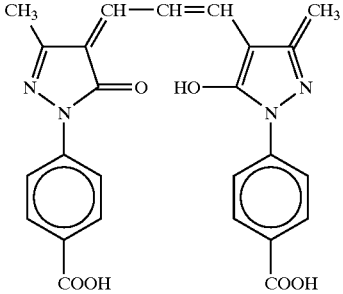
ExF-5
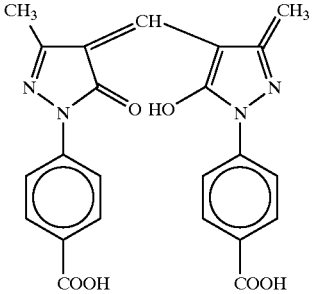

-continued

ExF-6

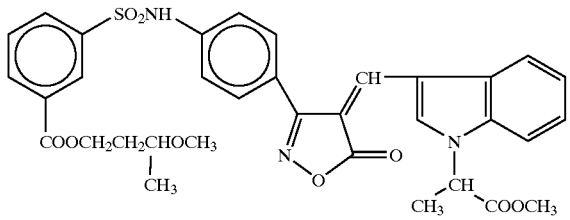

ExF-7

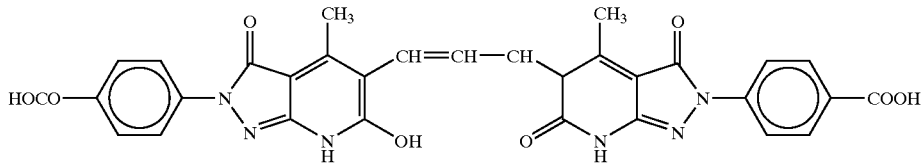

Samples 201 to 207 were obtained by replacing the Em-A in the 6th layer of the above silver halide color photographic lightsensitive material with Emulsions 1-A to 1-G, respectively, prepared in Example 1.

These samples 201 to 207 were exposed for 1/100 sec through a gelatin filter SC-39 manufactured by Fuji Photo Film Co., Ltd. and a continuous wedge.

The development was done as follows by using an automatic processor FP-360B manufactured by Fuji Photo Film Co., Ltd. Note that the processor was remodeled so that the overflow solution of the bleaching bath was not carried over to the following bath, but all of it was discharged to a waste fluid tank. The FP-360B processor was loaded with evaporation compensation means described in Journal of Technical Disclosure No. 94-4992.

The processing steps and the processing solution compositions are presented below.

(Processing Steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

*The replenishment rate was per 1.1 m of a 35-mm wide sensitized material (equivalent to one 24 Ex. 1)

The stabilizer and the fixing solution were counterflowed in the order of (2)→(1), and all of the overflow of the washing water was introduced to the fixing bath (2). Note that the amounts of the developer carried over to the bleaching step, the bleaching solution carried over to the fixing step, and the fixer carried over to the washing step were 2.5 mL, 2.0 mL and 2.0 mL per 1.1 m of a 35-mm wide sensitized material, respectively. Note also that each crossover time was 6 sec, and this time was included in the processing time of each preceding step.

The opening area of the above processor for the color developer and the bleaching solution were 100 $cm^2$ and 120 $cm^2$, respectively, and the opening areas for other solutions were about 100 $cm^2$.

The compositions of the processing solutions are presented below.

| (Color developer) | [Tank solution] (g) | [Replenisher] (g) |
|---|---|---|
| Diethylenetriamine pentaacetic acid | 3.0 | 3.0 |
| Disodium catechol-3,5-disulfonate | 0.3 | 0.3 |
| Sodium sulfite | 3.9 | 5.3 |
| Potassium carbonate | 39.0 | 39.0 |
| Disodium-N,N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7 tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and surfuric acid) | 10.05 | 10.18 |

| (Bleaching solution) | [Tank solution] (g) | [Replenisher] (g) |
|---|---|---|
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |

(Fixer (1) Tank Solution)

A 5:95 mixture (v/v) of the above bleaching tank solution and the below fixing tank solution (pH 6.8)

| (Fixer (2)) | [Tank solution] (g) | [Replenisher] (g) |
|---|---|---|
| Ammonium thiosulfate (750 g/L) | 240 mL | 720 mL |

-continued

| (Fixer (2)) | [Tank solution] (g) | [Replenisher] (g) |
|---|---|---|
| Imidazole | 7 | 21 |
| Ammonium Methanthiosulfonate | 5 | 15 |
| Ammonium Methanesulfinate | 10 | 30 |
| Ethylenediamine tetraacetic acid | 13 | 39 |
| Water to make | 1.0 L | 1.0 L |
| pH (adjusted by ammonia water and acetic acid) | 7.4 | 7.45 |

(Washing Water)

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. subsequently, 20 mg/L of sodium isocyanuric acid dichloride and 150 mg/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| 1,2-benzisothiazoline-3-on sodium | 0.10 |
| Disodium ethylenediamine tetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

The sensitivity and dependence on processing of each of exposed and developed samples 201 to 207 were measured in the same manner as in Example 1. The exposure was performed with a red filter, and measurements were performed with respect to cyan density.

Table 6 shows the result of the measurements.

TABLE 6

| Sample name | Emulsion name | Sensitivity | Dependence on processing | |
|---|---|---|---|---|
| 201 | 1-A | 100 | 100 | Comparative example |
| 202 | 1-B | 105 | 140 | Comparative example |
| 203 | 1-C | 163 | 185 | Comparative example |
| 204 | 1-D | 205 | 90 | Present invention |
| 205 | 1-E | 215 | 85 | Present invention |
| 206 | 1-F | 185 | 96 | Present invention |
| 207 | 1-G | 180 | 90 | Present invention |

As in Example 1, emulsions of the present invention had a high sensitivity and a small dependence on processing, and the effect of the present invention was remarkable also in Example 2.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic emulsion comprising grains, wherein not less than 50% of the number of all the grains are occupied by silver iodobromide or silver bromochloroiodide tabular grains each meeting the requirements (i) to (iii) below:

(i) a thickness is less than 0.13 μm;

(ii) an equivalent-circle diameter is not less than 1.0 μm; and (iii) the tabular grains each have a fringe internal portion meeting the following requirements (a) and (b), the fringe internal portion consisting of a fringe internal region A1 sandwiched between a twin plane and a major surface closer to the twin plane, a fringe internal region A2 sandwiched between another twin plane and another major surface, and a fringe internal region B sandwiched between said twin planes:

(a) a silver iodide content in the fringe internal region A1 and a silver iodide content in the fringe internal region A2 are substantially the same, and (b) the silver iodide content in each of the fringe internal regions A1 and A2 is higher than a silver iodide content in the fringe internal region B.

2. The silver halide photographic emulsion according to claim 1, wherein the thickness is less than 0.10 μm.

3. The silver halide photographic emulsion according to claim 1, wherein not less than 70% of the number of all the grains are occupied by the tabular grains each meeting the requirements (i) to (iii).

4. The silver halide photographic emulsion according to claim 1, wherein not less than 90% of the number of all the grains are occupied by the tabular grains each meeting the requirements (i) to (iii).

5. The silver halide photographic emulsion according to claim 1, wherein the variation coefficient of equivalent-circle diameters of all the grains is not more than 30%.

6. The silver halide photographic emulsion according to claim 1, wherein the variation coefficient of equivalent-circle diameters of all the grains is not more than 20%.

7. The silver halide photographic emulsion according to claim 1, wherein the variation coefficient of thickness of all the grains is not more than 30%.

8. The silver halide photographic emulsion according to claim 1, wherein the variation coefficient of thickness of all the grains is not more than 20%.

9. The silver halide photographic emulsion according to claim 1, wherein the tabular grains further meet the following requirement (iv):

(iv) the distance between two twin planes is 0.016 μm or less.

10. The silver halide photographic emulsion according to claim 1, wherein the tabular grains further meet the following requirement (v):

(v) the distance between two twin planes is 0.014 μm or less.

11. The silver halide photographic emulsion according to claim 1, wherein the tabular grains further meet the following requirement (vi):

(vi) the distance between two twin planes is 0.012 μm or less.

12. The silver halide photographic emulsion according to claim 1, wherein the silver iodide content in each of the fringe internal regions A1 and A2 is 7 mol % or more.

13. The silver halide photographic emulsion according to claim 1, wherein the silver iodide content in each of the fringe internal regions A1 and A2 is 10 mol % or more.

14. The silver halide photographic emulsion according to claim 1, wherein the silver iodide content in each of the fringe internal regions A1 and A2 is 12 mol % or more.

15. The silver halide photographic emulsion according to claim 1, wherein the silver iodide content in the fringe internal region B is lower than the silver iodide content in each of the fringe internal regions A1 and A2 by 2 mol % or more.

16. The silver halide photographic emulsion according to claim 1, wherein the silver iodide content in the fringe internal region B is lower than the silver iodide content in each of the fringe internal regions A1 and A2 by 4 mol % or more.

17. The silver halide photographic emulsion according to claim 1, wherein the silver iodide content in the fringe internal region B is lower than the silver iodide content in each of the fringe internal regions A1 and A2 by 7 mol % or more.

* * * * *